US011183313B2

(12) United States Patent
Crichlow

(10) Patent No.: US 11,183,313 B2
(45) Date of Patent: Nov. 23, 2021

(54) SYSTEMS AND METHODS FOR NUCLEAR WASTE DISPOSAL USING GRIDS

(71) Applicant: Henry Crichlow, Norman, OK (US)

(72) Inventor: Henry Crichlow, Norman, OK (US)

( * ) Notice: Subject to any disclaimer, the term of this patent is extended or adjusted under 35 U.S.C. 154(b) by 0 days.

(21) Appl. No.: 17/024,530

(22) Filed: Sep. 17, 2020

(65) Prior Publication Data

US 2021/0005338 A1 Jan. 7, 2021

Related U.S. Application Data

(63) Continuation-in-part of application No. 16/285,199, filed on Feb. 26, 2019, now Pat. No. 10,807,132.

(60) Provisional application No. 63/033,915, filed on Jun. 3, 2020.

(51) Int. Cl.

| | |
|---|---|
| ***G21F 9/36*** | (2006.01) |
| ***G21F 9/34*** | (2006.01) |
| ***E21B 15/00*** | (2006.01) |
| ***G21F 9/30*** | (2006.01) |

(52) U.S. Cl.

CPC ..... *G21F 9/34* (2013.01); *E21B 15/003* (2013.01); *G21F 9/304* (2013.01)

(58) Field of Classification Search

CPC ..... G21F 9/34

See application file for complete search history.

(56) References Cited

U.S. PATENT DOCUMENTS 335,579 A * 2/1886 Gutzloe ..... A63B 61/00 473/490
3,608,318 A * 9/1971 Levy ..... E02D 3/12 405/266
4,146,095 A * 3/1979 Alspaw ..... E21B 43/2403 166/247
5,186,119 A * 2/1993 Hlavin ..... A63C 19/062 116/201
5,850,614 A 12/1998 Crichlow
6,238,138 B1 5/2001 Crichlow (Continued)

OTHER PUBLICATIONS

"The Cigeo Project, Meuse/Haute-Marne reversible geological disposal facility for radioactive waste", Project Owner File, Public debate of May 15 to Oct. 15, 2013, ANDRA, Paris, France. {312FFDD4-7C0D-4DE1-B6B0-BB38E69B19AB.

(Continued)

*Primary Examiner* — Janine M Kreck
(74) *Attorney, Agent, or Firm* — Eric Kelly

(57) ABSTRACT

Systems and methods for long-term disposal of nuclear and/or radioactive waste materials, in liquid, solid, and/or other physical forms, using an array deeply located human-made caverns (caverns), wherein the array of caverns are within a deep geologic rock formation and below a grid pattern on a surface of the Earth. Each cavern is made from a substantially vertical wellbore, by drilling and under reaming operations upon a distal portion of the substantially vertical wellbore. At least some of the caverns may be connected by intersecting substantially lateral wellbores that may facilitate injection of protective materials into the caverns that are so intersected. The nuclear and/or radioactive waste may be preprocessed from original surface storage site(s), transported, temporarily surface stored, and then finally further processed at a selected wellsite before injection into a given of the subterranean deep caverns within the deep geologic rock formation.

24 Claims, 11 Drawing Sheets

(56) References Cited

U.S. PATENT DOCUMENTS

| | | | | |
|---|---|---|---|---|
| 8,925,658 | B2 | 1/2015 | Bryant | |
| 8,933,289 | B2 | 1/2015 | Crichlow | |
| 9,518,429 | B2 | 12/2016 | Fortson | |
| 9,677,298 | B2 | 6/2017 | Konduc | |
| 10,427,191 | B2 | 10/2019 | Crichlow | |
| 10,487,582 | B2 | 11/2019 | Wright et al. | |
| 10,518,302 | B2 | 12/2019 | Crichlow | |
| 2010/0105975 | A1* | 4/2010 | Baird | E21B 41/0057 588/16 |
| 2014/0147218 | A1* | 5/2014 | De Vries | E02B 3/122 405/302.6 |

OTHER PUBLICATIONS

"Chemical and Nuclear Waste Disposal: Problems and Solutions", James P. Murray,JosephJ. Harrington, and Richard Wilson, Cato Journal, vol. 2, No. 2 (Fall 1982). Cato Institute. Harvard University, Cambridge, Massachusetts 02138.

"Radioactive Waste Management and Decommissioning in Sweden, National Framework for Management and Regulation of Radioactive Waste and Decommissioning". Swedish Radiation and Safety Authority. Sweden, 2012.

"Characteristics of Used CANDU Fuel Relevant to the Canadian Nuclear Fuel Waste Management Program", K.M Wasywich., AECL Research, Whiteshell Laboratories, Pinawa, Manitoba, 1993.

"Canadian Power Reactor Fuel", R D Page. AECL 5609, Atomic Energy of Canada Limited, Power Projects, Sheridan Park Research Community, Mississauga, Ontario, L5K 182, Mar. 1976.

"CANDU 6 Technical Summary", AECL—CANDU 6 Program Team, Reactor Development Business Unit May 2005, 2251 Speakman Drive, Mississauga, Ontario, Canada L5K 1B2.

"Cost Estimate for a Deep Geologic Repository for Used Nuclear Fuel", Issue 1, 1106/MD18085/REP/02, Canadian Nuclear.

"Advanced Fuel Pellet Materials and Fuel Rod Design for Water Cooled Reactors", AEA-TECDOC-1654, Proceedings of a Technical Committee Meeting Held in Villigen, Nov. 23-26, 2009, International Atomic Energy Agency Vienna, 2010.

"Costs from and including 2018 for the radioactive residual products from nuclear power Basis for fees and guarantees for the period 2018-2020". SKB, Technical Report, TR-17-02, Apr. 2017.

"The search for a nuclear graveyard", The Globe and Mail, Oct. 25, 2019. Available online at: https://www.theglobeandmail.com/news/national/the-search-for-a-nuclear-graveyard/article4288430/.

"High level radioactive waste", Canadian Nuclear Safety Commission, Available online at nuclearsafety.gc.ca/eng/waste/high-level-waste/index.cfm.

"Deep Geological Repository Conceptual Design Report Crystalline / Sedimentary Rock Environment", J. Noronha, Nuclear Waste Management Organization, APM-REP-00440-0015 R001 May 2016.

"APM 2016 Lifecycle Cost Estimate, Update Summary Report", Nuclear Waste Management Organization, APM-REP-00440-0202 Apr. 2016.

"Moving Forward Together Process for Selecting a Site for Canada's Deep Geological Repositor for Used Nuclear Fuel", NWMO, Nuclear Waste Management Organization, 22 St. Clair Avenue East, 6th Floor, Toronto, ON M4T 2S3, Canada.

"Report on Separate Disposal of Defense High-Level Radioactive Waste", USDOE, Mar. 2015.

"Motion to withdraw", US NRC before Judge Thomas S Moore, Docket No. 63-001, ASLBP: No. 09-892-HLW-CAB04. Mar. 3, 2010.

"Environmental Impact Statement for a Geologic Repository for the Disposal of Spent Nuclear Fuel and High-Level Radioactive Waste at Yucca Mountain, Nye County, Nevada Feb. 2002",. U.S. Department of Energy, Office of Civilian Radioactive Waste Management, OE/EIS-0250.

"Disposal of High-Level Nuclear Waste", GAO US Government Accountability Office, Available online at https://www.gao.gov/key issues/disposal of high level nuclearwaste/issue_ summary.

"International investigations of geologic media for the disposal of radioactive Wastes", Chapter Dec. 1980, DOI: 10.1016/B978-1-4832-8421-7.50201-5, Kenneth S. Johnson, S Gonzales. University of Oklahoma, Available online at: https://www.researchgate.net/publication/285671410.

Life after Yucca Mountain: The time has come to reset US nuclear waste policy>,| TheHill, By David Klaus and Rod Ewing, Opinion Contributors—Dec. 9, 2019 09:30 AM EST.

"Nuclear Waste Disposal: Alternatives to Yucca Mountain", Specialist in Energy Policy, Feb. 6, 2009, Congressional Research Service. www.crs.gov.

"Nuclear Waste Dump", The Canadian Press, Caanada News, Castanet.net. Jan. 3, 2017.

"Canada narrows list of possible locations for nuclear waste facility", CBC News, Apr. 9, 2014\ CBC Canada.

"Sask. First Nations Get $1M to Explore Nuclear Waste Storage", Postmedia News, Available online https://nationtalk.ca/story/sask-first-nations-get-1m-to-explore-nuclear-waste-storage-postmedia-news.

"All Holtec nuclear waste thin-wall canisters likely damaged from inferior Holtec downloading systems", May 16, 2019, Donna Gilmore, San Onofre Safety Available online—https://sanonofresafety.org/blog/.

"Decades old war over Yucca Mountain nuclear dump resumes under Trump budget plan", R Vartabedian, LA Times, Mar. 29, 2017.

"This is how we manage Sweden's radioactive waste", Activities 1995, Swedish Nuclear Fuel! And Waste Management Company. S. Bjurstrom, CEO. 1995.

"Sweden plans first ultimate storage site for nuclear waste", Available online at: https://www.dw.com/en/sweden-plans-first-ultimate-storage-site-for-nuclear-waste/.

* cited by examiner

NOT TO SCALE

| | METRIC TONS - CAVERN CAPACITY OF HLW METAL @ 18.9 GM/CC | | | | |
|---|---|---|---|---|---|
| CAVERN | | | DIAMETER - INCHES | | |
| LENGTH | 36 | 48 | 60 | 72 | 84 |
| 1,000 | 3,784 | 6,726 | 10,510 | 15,134 | 20,599 |
| 2,000 | 7,567 | 13,453 | 21,020 | 30,268 | 41,198 |
| 3,000 | 11,351 | 20,179 | 31,529 | 45,402 | 61,798 |
| 4,000 | 15,134 | 26,905 | 42,039 | 60,536 | 82,397 |
| 5,000 | 18,918 | 33,631 | 52,549 | 75,670 | 102,996 |
| 6,000 | 22,701 | 40,358 | 63,059 | 90,805 | 123,595 |
| 7,000 | 26,485 | 47,084 | 73,569 | 105,939 | 144,194 |
| 8,000 | 30,268 | 53,810 | 84,078 | 121,073 | 164,793 |
| 9,000 | 34,052 | 60,536 | 94,588 | 136,207 | 185,393 |
| 10,000 | 37,835 | 67,263 | 105,098 | 151,341 | 205,992 |

FIG. 9 ( TABLE 1 )

SYSTEMS AND METHODS FOR NUCLEAR WASTE DISPOSAL USING GRIDS

PRIORITY NOTICE

The present application claims priority under 35 U.S.C. § 119(e) to U.S. Provisional patent application Ser. No. 63/033,915 filed on Jun. 3, 2020, the disclosure of which is incorporated herein by reference in its entirety.

The present patent application is a continuation-in-part (CIP) of U.S. non-provisional patent application Ser. No. 16/285,199 filed on Feb. 26, 2019, and claims priority to said U.S. non-provisional patent application under 35 U.S.C. § 120. This U.S. non-provisional identified patent application is incorporated herein by reference in its entirety as if fully set forth below.

CROSS REFERENCE TO RELATED PATENTS

This present U.S. non-provisional patent application is related to previous U.S. patents by the same inventor related to the disposal of nuclear waste in deep underground formations, wherein these U.S. patents are: U.S. Pat. Nos. 5,850,614, 6,238,138, and 8,933,289; wherein the disclosures and contents of which are incorporated herein by reference in their entireties as if fully set forth below.

TECHNICAL FIELD OF THE INVENTION

The present invention relates in general to disposing of nuclear and/or radioactive materials (waste) and more particularly, to: (a) drilling and under reaming operations to develop an array of specialized underground human-made caverns for receiving the nuclear/radioactive waste; (b) utilization of the specialized human-made caverns implemented in deep geological formations, such that, the nuclear/radioactive waste is disposed of safely, efficiently, and economically; and (c) operations of the nuclear/radioactive waste disposal. The present invention relates specifically to containment, storage, and/or disposal of nuclear and/or radioactive materials within an array of human-made subterranean cavities within deep geological formation(s) which are formed beneath a grid pattern located on the surface of the Earth.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Today (e.g., circa 2020) there is a massive quantity of highly dangerous nuclear waste accumulating across the world. In the United States (U.S.) alone there are more than 80,000 metric tons (MT) of high-level solid nuclear waste (HLW) being stored in cooling pools and in concrete casks on the surface of the Earth. These existing surface operations are very costly, typically costing hundreds of millions of dollars annually. And these existing surface operations were never intended for the long-term disposal of HLW. The HLW is generally called spent nuclear fuel (SNF) and often consists of thousands of nuclear fuel assemblies which have been removed from operating nuclear power plants. These SNF fuel assemblies are highly radioactive and also thermally active and continue to generate sensible heat which must be safely removed by maintaining these assemblies in cooling tanks at the onsite surface storage sites. There are approximately 90,000 individual fuel assemblies being stored today in the U.S. and about 2,500 MT being added annually. There is a significant need for new mechanisms and processes to safely get rid of the surface storage of this radioactive waste and to sequester this SNF waste in a safe manner. In this patent application HLW and SNF may be used interchangeably to describe the solid nuclear waste product.

In the U.S., the nuclear weapons production industry has left a massive and devastating legacy when the nuclear reactors were decommissioned at the end of the Cold War. For example, the nuclear weapons manufacturing process left behind about 53 million U.S. gallons (volumetric equivalent of about 800,000 cubic meters [$m^3$]) of high-level radioactive waste stored within 177 storage tanks. In addition, 25,000,000 cubic feet ($ft^3$) (710,000 $m^3$) of solid radioactive waste and a resulting contamination zone covering several square miles of contaminated groundwater beneath the site. Much of this liquid waste has been leaking into the surrounding earth creating significant health and environmental problems. There is a tremendous safety and environmental need to store and/or dispose of such radioactive materials.

Some attempts have been made in the past to solve these problems of the safe and cost-effective long-term disposal of nuclear/radioactive waste materials. Most major countries with nuclear power generating systems and nuclear weapons programs, have made plans to safely sequester the nuclear waste. For example, currently, Sweden, U.S., France, Canada, Germany, and Russia are contemplating various means of nuclear waste disposal.

In the past, it has been challenging, dangerous, and expensive to try to store radioactive and/or nuclear materials (such as waste materials) in underground caverns except for those cases where solid quantities of material are stored in barrels, individual capsular containers, slurry material, open pits and also within shallow mines which are generally very close to the surface of the Earth.

There has not been any attempt to store radioactive materials in very deep caverns because: (a) such deeply located caverns do not generally naturally exist in rock formations at very great depths; and (b) in the past it has been impossible to fabricate or produce large diameter deep human-made caverns or to implement them in deep enough geological formations which are necessary to maintain a level of safety such that there would be no migration of radionuclides from the radioactive materials to the surface of the Earth over geologic time scales.

However, underground human-made caverns have been used to store natural gas, hydrocarbon liquids, waste-water, petroleum products, and other commercial products for many decades. These caverns have generally been drilled into and/or leached from subsurface salt domes or salt formations which have been formed over geologic time by salt intrusions or depositions from regional seas or other long-gone aqueous environments. Operationally, human-made caverns, located in a given salt formation, are typically created by injecting fresh water into subterranean salt formations and leaching and withdrawing the resulting brine. This process is referred to as solution mining. Over time, numerous human-made salt caverns have been solution mined by the petroleum industry for use in storing hydrocarbons like the Strategic Petroleum Reserve which holds hundreds of millions of barrels of crude oil; and for disposing of nonhazardous oilfield wastes (NOW).

To date (circa 2020), human-made caverns located in salt formations have not been used to store and/or dispose of radioactive materials due to concerns that such caverns may leak radioactive materials into surrounding rocks and, perhaps, into freshwater aquifers. Additionally, in underground gas storage operations, it has been demonstrated that over time the cyclic injection-production operations of the natural gas with the cycling of pressures inside the salt dome can create "salt creep" in which the human-made cavern within the given slat formation becomes progressively smaller in volume and eventually useless for large storage purposes. Some better, more permanent mechanisms are needed for radioactive material storage and disposal other than human-made caverns within salt formations.

Today (2020) many political entities and nations are focused on the use of some sort of subterranean tunneling systems to dispose of the HLW waste. For example, Sweden, Canada, United States, and France all have at least partially developed massive HLW disposal systems that are conceived to be implemented in relatively shallow rock zones in underground mining type environments. For example, FIG. 1, FIG. 2, and FIG. 3, show three such prior art HLW disposal systems based on mining technologies and mining environments in relatively shallow underground rock zones. FIG. 1 shows an overview of a prior art underground nuclear waste disposal system as contemplated for Sweden. FIG. 2 shows an overview of a prior art underground nuclear waste disposal system as contemplated for Canada. FIG. 3 shows an overview of a prior art underground nuclear waste disposal system as contemplated for Yucca Mountain (Mt.) in the (U.S.). Sweden is the farthest along in implementing its technology as of 2020. The U.S. FIG. 3 system has been on the drawing board since 1978 and it is now "temporarily" shut down.

A specific example of the prior art may be seen in the Sweden model for HLW waste disposal as shown in FIG. 1. This FIG. 1 disposal system is an estimated to cost $15.7 Billion USD to build out. This FIG. 1 disposal system is an underground mining tunneling system in which a series of approach tunnels 11, transport tunnels 11, staging areas, and deposition tunnels 14 are drilled (carved/mined out) into the disposal formation 12 with large complex mining tunneling equipment. This FIG. 1 disposal system project is estimated to occur over a 30-year time horizon. This FIG. 1 disposal system's basic design concept contemplates disposing the spent nuclear fuel (SNF and/or HLW) in graphite, copper cast-iron canisters that are emplaced in crystalline rock at depths of around 500 meters (i.e., about 1,640 feet). These graphite cast-iron canisters are supposed to have an outer layer that is 15 millimeters (mm) thick and encased in a corrosion barrier composed of copper metal. After filling these canisters with the SNF/HLW, they are sealed, and then these copper cast-iron canisters are to be emplaced individually in vertical boreholes in the floors of the deposition tunnels 14 which have been excavated off of the central delivery tunnels 11 which are implemented in the disposal system. The spaces between the copper cast-iron canisters and the walls of the boreholes are to be filled with compacted bentonite. The tunnels 14 and shafts 14 will be backfilled with bentonite material that is made of compacted granite blocks and pellets, along with ceiling plugs which are put in place to block specific transport pathways 11 from ground water and/or from radionuclides.

Additionally, or alternatively, Sweden also can utilize the horizontal placement of "super" containers in their disposal system. The super containers are of a copper canister surrounded by a pre-compacted bentonite blocks in an outer metal shell. The function of the canister in both designs is to isolate SNF/HLW from the surrounding environment. The design lifetime of the Sweden canister is expected to be at least 100,000 years. In addition to the required chemical resistances, the canisters must also have sufficient mechanical strength to withstand the hydraulic pressures within the system at a depth of 700 meters (m). In order to meet these requirements, the canisters have been designed with an insert that provides mechanical strength for the SNF/HLW fuel assemblies in fixed positions. The outer copper shell provides corrosion protection for the canister. This outer shell is made of oxygen free copper to improve the creep strength and creep ductility of copper, wherein 30 to 100 parts per million (ppm) of phosphorus is added to this oxygen free conductive copper. This FIG. 1 system is complex, expensive, dangerous, and difficult to implement with operating personnel and equipment underground working with radioactive materials for several years.

Most of the prior art current methods which are contemplated for the storage of HLW (and/or SNF) waste by these countries (and other similar countries) have generally comprise the following types of features. They generally have a very large surface footprint which is almost the size of a small town or massive mining type field operation, which is setup above the Earth's surface to allow the for the underground mining operations, electric power generation and distribution systems, living quarters for personnel, transport and protected temporary storage facilities for the development of the underground disposal systems. Generally, these types of massive surface developments meet strong and concerted public resistance which is difficult to overcome and which creates almost impossible problems (e.g., "not in my backyard [NIMBY]) leading to unfinished projects (e.g., the FIG. 3 Yucca Mt. project).

Further, these prior art underground disposal systems usually have implemented the very long underground approach tunnels 11 to reach the disposal tunnels 14. The long approaches 11 are often spirally designed to allow the tunnels 11 to reach into the rock zones 12 without having very dangerous and steep grades or route system to allow vehicular traffic or rail traffic. In addition, these prior art underground disposal systems have large underground, protected staging or "cathedral like" areas for storage of the HLW waste material underground before final emplacement. The length and large diameters of the approach tunnels 14 and the large cathedral like staging areas are all expensive to build and maintain, and vulnerable to collapse.

In addition, all these prior art underground disposal systems would involve some sort of protective canister type systems for housing the SNF/HLW, which are designed to be structurally protective and also protective of radionuclide transport over the short and long term. These storage containers are also designed with massive shielding for corrosion against also radionuclide transmission and also for structural integrity. These prior art canisters have been designed to mitigate corrosion. These prior art canisters are designed to be the first line of defense for the waste process. This type of corrosion protective approach is short sighted since corrosion over millenia is a complex and incompletely understood phenomenon. Disposal times should be measured in hundreds of thousands of years. By focusing herein on the deep formation storage/disposal approach, the primary protective system is the deeply located rock formation itself. The deep geological formation contemplated herein is closed, impermeable, massive, and remote from any corrosion producing environment processes like oxidizers, surface waters or chemical contaminants. Such deep geological formations, as contemplated herein, as radioactive waste depositories thus provide a much better solution.

Finally, these prior art underground disposal systems are designed to have some sort of continual surface monitoring system designed for thousands of years, at entry points to protect the public from radiation and also to prevent pilferage of the radioactive waste materials. Pilferage of nuclear waste material from a mine may be easily done unless the mine is completely isolated by massive earthen deposits. However, given the shallowness of these prior-art systems, alternate re-entry may be established by a determined agent using well camouflaged surface operations. Whereas, in contrast, pilferage from a deep wellbore in a geologically deep disposal formation, as contemplated herein, is almost impossible, particularly after the wellbore and/or the human-made cavern have been sealed. Pilferage from a deep wellbore in a geologically deep disposal formation requires a massive, easily detectable drilling rig operating for at least several months. Finally, the chance of radiation from a radioactive waste source buried tens of thousands of feet in a closed geological formation in steel casings, as contemplated herein, is infinitesimally small or non-existent.

In addition, some prior art disposal systems implement "drip" shields made of expensive titanium metal to cover in an umbrella-like fashion to protect the waste canisters from percolating rainwater from the surface or inflow from the water table. The inclusion of these titanium drip shields requires significant additional underground structural additions to the disposal infrastructure to support the shields. These support structures for shields have to be emplaced prior to inclusion of the titanium shields. In addition, operationally, the inclusion of the titanium shields may have to be done after the deposition of total repository waste has been completed. This may mean a waiting period of about 30 years before shields are implemented. Because of these problems, it would be desirable to have a HLW/SNF disposal system that does not require such drip shields. Also, siting the disposal system in a deep geological formation, as illustrated herein, precludes the need for any type drip shield because there is no surface water migration (dripping) in these deep repository zones.

A need, therefore, exists for new systems and/or methods for the safe and cost-effective disposal of radioactive wastes in a controlled manner along with depositing these radioactive wastes into deeply located receiving volumes that are designed to meet the requirements of public acceptance along with regulatory guidelines.

For example, and without limiting the scope of the present invention, some embodiments of the present invention may be systems and/or methods for the disposal of nuclear and/or radioactive materials by: (a) implementing an array of large human-made caverns, beneath a grid pattern on the surface of the Earth, wherein the human-made caverns are located within at least one deep geological formation; (b) preparing the nuclear and/or radioactive materials for disposal and then disposing (e.g., loading) of the nuclear and/or radioactive materials into the array of the human-made caverns; and (c) sealing these deeply located human-made caverns, that contain the nuclear and/or radioactive materials, to prevent migration and contamination of the outside environment. The grid pattern on the surface of the Earth may have a significantly smaller surface footprint than that of the footprints of the prior art, particularly in light of how much nuclear/radioactive waste may be disposed of per the size of the given surface footprint; i.e., the systems and method contemplated herein may dispose of significantly more nuclear/radioactive waste than the prior art while using a significantly smaller surface footprint (grid pattern). Further, the nuclear and/or radioactive materials may be fixed in specialized protective media environments within the given human-made caverns. Because the array of the sealed/closed human-made caverns, with the nuclear and/or radioactive materials, are located within the deep geological formation, the nuclear and/or radioactive materials are safely sequestered from people, outside environments, and the ecosphere in general.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe devices, machines, equipment, mechanisms, means, systems, methods, portions thereof, and/or combinations thereof for the storage and/or the disposal of nuclear/radioactive materials within a "close" packed array of multiple human-made subterranean cavities, wherein such human-made caverns are located within at least one deep geological formation, and wherein the array of human-made caverns are located directly below a grid pattern located on the surface of the Earth. In some embodiments, the grid pattern may comprise a plurality of grids and at least one of those grids may comprise at least one drill site, wherein it may be from such drill sites that a given human-made cavern may be located beneath. In some embodiments, "close" packing may mean a given grid selected from the grid pattern may have a dimension of about twenty (20) feet to about 100 feet. In some embodiments, adjacently located human-made caverns may be from about twenty (20) feet to about 100 feet apart.

Briefly, the disposal systems and/or methods in accordance with some embodiments of this invention may achieve the intended objectives by including steps of: drilling substantially vertical pilot wells (wellbores) according to a preset grid pattern located on the surface of the Earth, wherein these substantially vertical wellbores intersect at least one deep geologic formation that is located directly below the grid pattern; and creation of an array of human-made cavern within that deep geological formation, using under reaming from distal/terminal portions of the substantially vertical wellbore. In addition, the systems and/or method may be designed to allow geometry and/or conditioning of the human-made caverns to be controlled, so that the life of the human-made caverns as a safe repository for nuclear waste can be maximized.

In recent years, in the oilfield drilling industries, over 2,500,000 feet of under-reaming drilling has been successfully achieved. The reaming technology in oil well drilling is not new. Reaming patents exist as early as 1939. However, the recent technological developments in the oil filed drilling industries have made it possible to help resolve the problems involved in making human-made caverns a reality in deep geologic zones, which was previously not technically feasible.

Furthermore, today (2020) oilfield drilling rigs have been modified and automated to allow a massive rig capable of lifting millions of pounds to automatically "walk" or "skid" itself across the surface of the Earth, over the ground in multiple directions, of a given oilfield. These "walking" drill rigs may be used to form the array of human-made caverns contemplated in this invention. Several patents for walking drill rigs exist today.

Because of oilfield drilling operations improvements, it is now possible to resolve the problems involved in disposing of nuclear waste in deep human-made caverns in compact areas and in volumes of disposal that are realistic, need, over very short time periods, that are safe, and that are greatly less expensive than the prior art nuclear waste disposal systems.

Some embodiments, may teach optimal locations of these disposal human-made caverns, such that maximum waste storage and minimum costs may be established while disposing of the nuclear/radioactive waste into the array of the deeply located human-made caverns developed below a limited surface of land (below the surface grid pattern).

The ability to economically provide the array human-made caverns, under a relatively small surface footprint, of sufficient size and volume of the human-made caverns, for the safe disposal of substantial quantities of radioactive waste is taught herein. What is required is more than just the ability to store some small amounts of waste in a single wellbore, as noted, there are needs for the disposal/storage of massive quantities of nuclear/radioactive waste and the disposal/storage in limited vertical wells is not economically practical.

For example, Table 1 below, shows the capacities of various sizes of human-made caverns taught herein, based on the published density of high-level waste (HLW) metal of 18.9 grams per cubic centimeter (cc). For example, in the top row, a 36-inch diameter human-made cavern that was reamed out to a depth of 1,000 feet, would hold 3,784 metric tons of 100% of HLW waste material having a density of 18.9 gm/cc, i.e., homogenous metal.

It should be noted that in practice, the actual density of the packaged disposed HLW waste may be significantly less because the HLW waste is not a solid homogenous consolidated material mass. The HLW waste may contain material parts, portions, and other constituent components that decrease the overall density based on the total volume of the waste package.

For example, and without limiting the scope of the present invention, a pressurized water reactor SNF (spent nuclear fuel) module has a published nominal volume of 0.186 cubic meters and a published total weight of 657.9 Kg (kilograms). A simple density calculation may provide an overall density of about 3.54 gm/cc for the composite SNF module. This indicates that if an unassembled SNF module were to be disposed of intact (unstripped down) into its component parts it would occupy 0.186 cubic meters or about 6.56 cubic feet of human-made cavern volume. The human-made caverns contemplated herein in this invention may contain several hundred thousand cubic feet of volume each. By developing an array of multiple human-made caverns (beneath a surface grid pattern) almost any quantity of produced SNF may be disposed under current technology as discussed herein in this patent application.

However, regardless of the density of the final waste package, the array of human-made caverns may be designed and selected with a total volume to accommodate all of the expected quantities of HLW waste for given site. For example, consider a situation where the HLW is designed such that the gross package waste density is 5 grams/cc, i.e., less than 20% of the true HLW waste metal density of 18.9 gm/cc. Then, the volume needed for one 1,000 metric tons of HLW waste metal is now five (5) times what is needed if the disposed metal were a "full 18.9 gram/cc" metal, i.e., a 5,000 metric ton size human-made cavern. As indicated in Table 1, the volume needed for new "downgraded" 1,000 metric tons is about a 3,000 foot deep human-made cavern with a three (3) foot diameter or a 1,000 foot deep human-made cavern with a five (5) foot diameter—either of which is very readily built as taught herein. Note, the depth of such human-made caverns is how far that given human-made cavern may extend into the given deep geological formation; i.e., in other words that depth may be thought of as a height or a length of the given human-made cavern, wherein the given human-made cavern once build is in a substantially vertical orientation.

TABLE 1

Showing human-made cavern capacity.

| CAVERN | METRIC TONS - CAVERN CAPACITY OF HLW METAL @ 18.9 GM/CC DIAMETER - INCHES | | | | |
|---|---|---|---|---|---|
| LENGTH | 36 | 48 | 60 | 72 | 84 |
| 1,000 | 3,784 | 6,726 | 10,510 | 15,134 | 20,599 |
| 2,000 | 7,567 | 13,453 | 21,020 | 30,268 | 41,198 |
| 3,000 | 11,351 | 20,179 | 31,529 | 45,402 | 61,798 |
| 4,000 | 15,134 | 26,905 | 42,039 | 60,536 | 82,397 |
| 5,000 | 18,918 | 33,631 | 52,549 | 75,670 | 102,996 |
| 6,000 | 22,701 | 40,358 | 63,059 | 90,805 | 123,595 |
| 7,000 | 26,485 | 47,084 | 73,569 | 105,939 | 144,194 |
| 8,000 | 30,268 | 53,810 | 84,078 | 121,073 | 164,793 |
| 9,000 | 34,052 | 60,536 | 94,588 | 136,207 | 185,393 |
| 10,000 | 37,835 | 67,263 | 105,098 | 151,341 | 205,992 |

In light of the problems associated with the known methods of disposing of nuclear waste (including in liquid/slurry format), it may be an object of some embodiments of the present invention, to provide a method for the disposal of nuclear waste in human-made caverns which is safe, with high volumetric capacity, that is cost-effective, and that may be performed with modified oil field equipment.

It may be another object of some embodiments of the present invention, to provide methods, of the type described herein, wherein a human-made cavern of substantial strength and durability, with sufficiently protective walls and volumetric capacity may be formed in a deep geologic formation being several thousand feet below the Earth's surface and wherein the human-made cavern may be several thousand feet in vertical extent with a reasonably large diameter of several feet. A human-made cavern of this size can provide close to 1,000,000 gallons of liquid radioactive waste storage. By enlarging the substantially vertical pilot wellbore to a significant diameter and continuing to vertically drill-out and under-ream the wellbore a given human-made cavern may be formed up to several thousand feet long/deep, resulting in the given permanent human-made cavern configured for the disposal/storage of radioactive waste.

Another object of the present invention is to provide a nuclear and/or the radioactive materials disposal method that uses multiple deeply located human-made disposal caverns, to reduce costs, increase disposal capacity, increase effectiveness, limit areal footprint on the surface, and limit harm from a single source of failure in the nuclear and/or the radioactive materials disposal process.

Another object of the present invention is to provide a nuclear and/or the radioactive materials disposal method using multiple deeply located human-made disposal caverns, that can integrate with the existing surface operations for preparing, transporting and disposing of nuclear and/or the radioactive materials, without excessive additional costs, environmental limitations, and political problems associated with current technological approaches.

It is an objective of the present invention to provide disposal method(s) for the long-term disposal of nuclear and/or radioactive waste.

It is another objective of the present invention to provide disposal method(s) that are effective, e.g., effective at preventing migration and/or contamination of radioactive materials and/or radionuclides out from the human-made caverns.

It is another objective of the present invention to provide disposal method(s) that are relatively and/or sufficiently safe for installation and/or operating personnel.

It is another objective of the present invention to provide disposal method(s) that are relatively and/or sufficiently safe to surrounding communities and/or the surrounding environment/ecosphere.

It is another objective of the present invention to provide disposal method(s) that are relatively cost effective compared to prior art methods.

It is another objective of the present invention to provide disposal method(s) that are relatively easy to implement in much shorter time periods compared to prior art methods.

It is another objective of the present invention to provide grid patterns on the surface of the Earth, above a given deep geological formation, wherein a footprint of the given grid pattern is smaller than the surface footprint of prior art nuclear waste disposal systems.

It is another objective of the present invention to dispose of nuclear and/or radioactive materials within human-made caverns that are located within and below a relatively small "areal footprint" in deep massive geological formations, compared to the extensive acreage (multiple square miles) required to implement prior art methods.

It is another objective of the present invention to drill and ream out arrays of human-made caverns in deep geological formations, located below grid patterns on the surface of the Earth.

It is another objective of the present invention to form human-made caverns configured for the storage/disposal of nuclear and/or radioactive waste.

It is another objective of the present invention to locate, create, make, and/or form the human-made caverns within deep geological formations.

It is another objective of the present invention to dispose of nuclear and/or radioactive waste within the human-made caverns that are located within the deep geological formations.

It is an objective of the present invention to avoid a need for drip shields, as design and implementation of the disposal system already accounts for and minimizes risk of ground water contamination.

It is another objective of the present invention to surround and protect the nuclear and/or the radioactive materials being disposed of, within a protective medium, wherein the combination of protective medium and the nuclear and/or the radioactive materials are both located within the human-made caverns, within the deep geological formations.

It is yet another objective of the present invention to seal off these deep human-made cavern(s) with, the nuclear and/or the radioactive materials (and/or with the protective medium), to prevent migration and contamination of the outside environment.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 5 may depict at least one walking drill rig disposed on top of the some region of that grid pattern, wherein that walking drill rig may move from drill site to drill site and drill wellbores and form human-made caverns beneath grid pattern.

FIG. 6 may depict a portion of a cross-sectional view through a portion of the grid pattern on the surface of the Earth along with a portion of a deep geological formation located vertically below that portion of the grid pattern, wherein a walking drill rig may be disposed on the surface of the Earth, a wellbore may connect the walking drill rig to a human-made cavern, wherein the human-made cavern may be located within the deep geological formation, and within the human-made cavern may be nuclear waste materials stored/disposed of.

FIG. 9 (Table 1) may show human-made cavern capacities.

Figure 1:
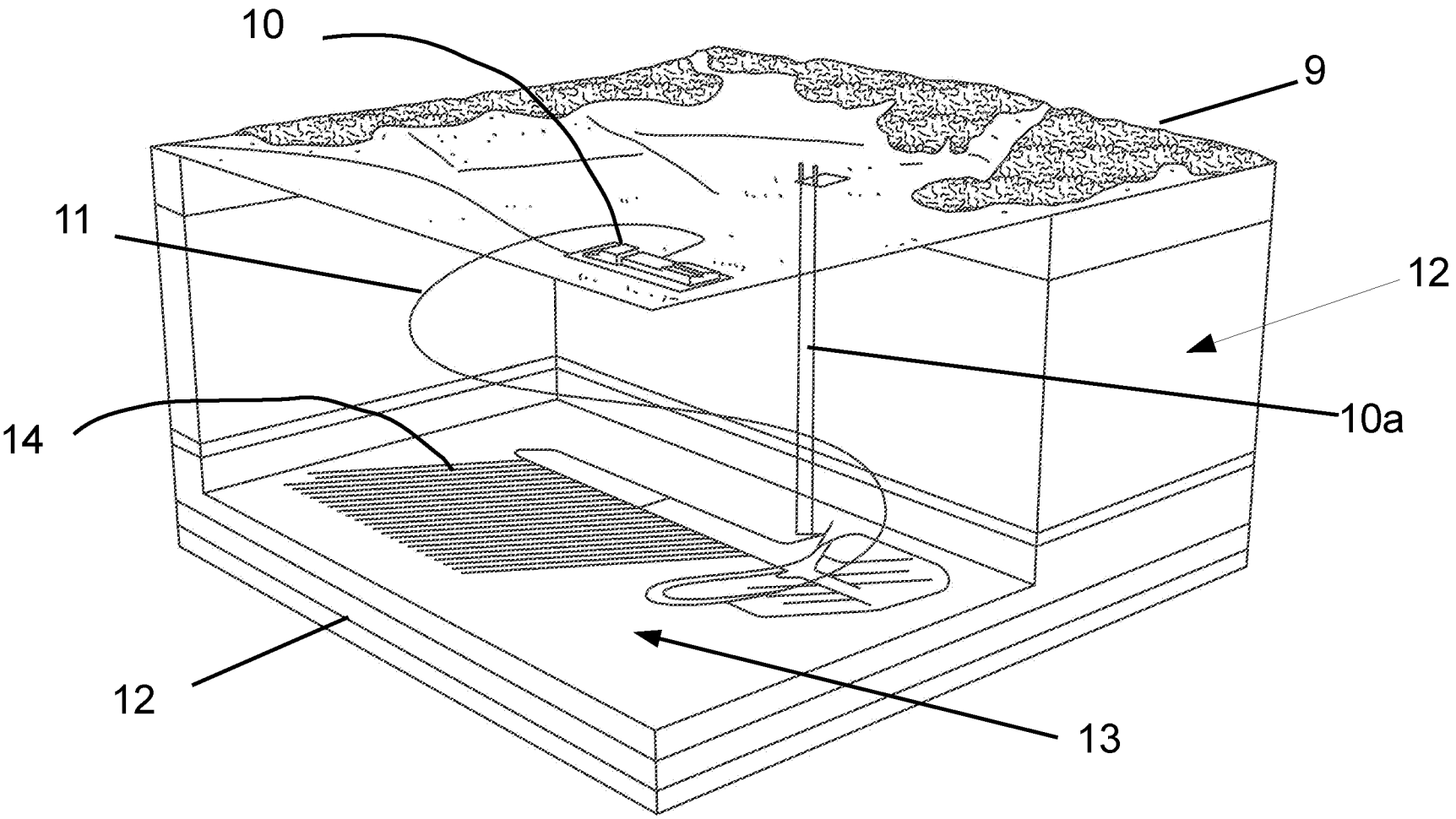
FIG. 1 (Prior Art)
FIG. 1 shows an overview of a prior art underground nuclear waste disposal system as contemplated for Sweden.

Table 1 may show human-made cavern capacities.

REFERENCE NUMERAL SCHEDULE (LISTING)

9 surface 9 (of the Earth)
9*a* drill site 9*a*
10 surface facilities 10
10*a* ventilation shafts 10*a*
11 transport tunnels/facilities 11
12 rock formations 12
13 disposal formations 13
14 disposal tunnels 14
15 human-made caverns 15
16 nuclear waste material 16
16*a* protective blanket 16*a*
16*b* immersive protective medium 16*b*
17 vertical (pilot) wellbore 17
17*a* connector wellbore system 17*a*
17*b* perforations 17*b* (in connector wellbore)
17*c* plug 17*c* (in connector wellbore)
17*d* down hole flow-control packer 17*d* (in connector wellbore)
18 walking drill rig 18
18*a* rig control module 18*a*
18*b* rig walking leg 18*b*
18*c* horizontal rig mover device 18*c*
18*d* vertical rig mover device 18*d*
18*e* hydraulic line 18*e*
18*f* direction of rig movement 18*f*
19 surface operations equipment/structures 19
20 drill rig support buildings 20
51 grid pattern 51
63 disposal formations 63
800 method of disposing of waste in gridded human-made caverns 800
801 step of designing grid pattern for waste storage in human-made caverns 801
802 step of selecting drill rig apparatus 802
803 step of locating and moving drill rig to drill site 803
804 step of setting up drill rig at drill site 804
805 step of drilling wellbore 805
806 step of under-reaming wellbore to form human-made cavern 806
807 step of conditioning human-made cavern 807
808 step of determining simultaneous operations 808
809 step of moving drill rig to another drill site 809
810 step of determining if all human-made caverns made 810
811 step of loading waste in human-made cavern 811
812 step of injecting protective media and/or additives 812
813 step of sealing wellbore and/or human-made cavern 813
814 step of drilling a connector lateral wellbore system 814
815 step of injecting protective media into the disposal cavern 815
816 step of completing and stopping the media injection into the cavern 816
817 step of stopping/ending method 817
850 method of disposing of waste in gridded human-made caverns 850

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

In this patent application, the words "well," "wellbore," and/or the like may be used interchangeably and may refer to cylindrical elements implemented in the design and installation processes of some embodiments discussed herein. References to well and/or wellbore without use of an accompanying reference numeral may refer to any of the wellbore sections discussed herein, such as, vertical wellbore 17.

In this patent application, the words "waste," "waste form," "waste material," "waste product," and/or the like may be used synonymously and/or interchangeably and may refer to various types of nuclear (radioactive) waste material 16 to be disposed of in deep geological human-made cavern 15 systems. In some embodiments, the waste to be disposed of and contemplated as being deposed of within the deep geological human-made cavern 15 systems may comprise: nuclear waste, radioactive waste, high-level nuclear waste (HLW), spent nuclear fuel (SNF), weapons grade plutonium (WGP), uranium-based waste products, depleted uranium products, depleted uranium penetrators (DUP), uranium hexafluoride (UF6), portions thereof, combinations thereof, and/or the like.

In this patent application, the words "deep geological rock formation 63," "host rock 63," "disposal formation 63," "host formation 63," and/or the like may be used synonymously and/or interchangeably.

In this patent application, directional language of "vertical" and "horizontal" may be with respect to a local gravitational vector of the Earth at a given grid pattern 51, i.e., "vertical" may be substantially parallel with this local gravitational vector and "horizontal" may be substantially perpendicular (orthogonal) with respect to this local gravitational vector. In other words, the directional language of "vertical" and "horizontal" may be with respect to a local surface 9 of the Earth at a given grid pattern 51, i.e., "vertical" may be substantially perpendicular (orthogonal) with this local surface 9 of the Earth and "horizontal" may be substantially parallel with respect to this local surface 9 of the Earth.

FIG. 1 illustrates a prior art scheme. FIG. 1 illustrates an inclusive overview of a preferred waste system to be developed in Sweden. The FIG. 1 system derives its origin from a massive mining approach in which a large system of tunnels and emplacements are made in granite rock 13, about 1,500 feet deep below the surface 9 of the Earth. The estimated cost to construct this waste system is about $17 Billion (USD). The estimated time of construction and emplacement is about 24 years. As stated by the Swedish Regulatory Agency: "The Deep repository for spent nuclear fuel. Deposition of waste in an initial stage is planned to take place in 2008 at the earliest. The site will be determined around the turn of the century. The canisters with spent fuel will be embedded in clay, in holes in the bottom of tunnels at a depth of about 500 metres in the bedrock. The repository will hold about 8,000 tonnes of fuel, which when encapsulated will have a volume of more than 10,000 cubic metres."

Continuing discussing FIG. 1, the disposal zone 13 is bounded by rock formations 12 above and below the disposal formation 13. Included are surface facilities 10 for managing and handling the high-level waste containers. A necessary part of the installation are ventilation shafts 10*a* needed to allow humans to work underground during the emplacement process. It is contemplated that these ventilation shafts 10*a* are to be sealed after use or used for monitoring purposes. Also are transport tunnels 11 that are needed and implemented to allow entry/egress means of personnel and material to manage the process of disposal. The high-level waste 16 is sequestered in specially made containers which are stored in the emplacement or disposal tunnels 14 which are excavated off the connecting transport tunnels 11.

Figure 2:
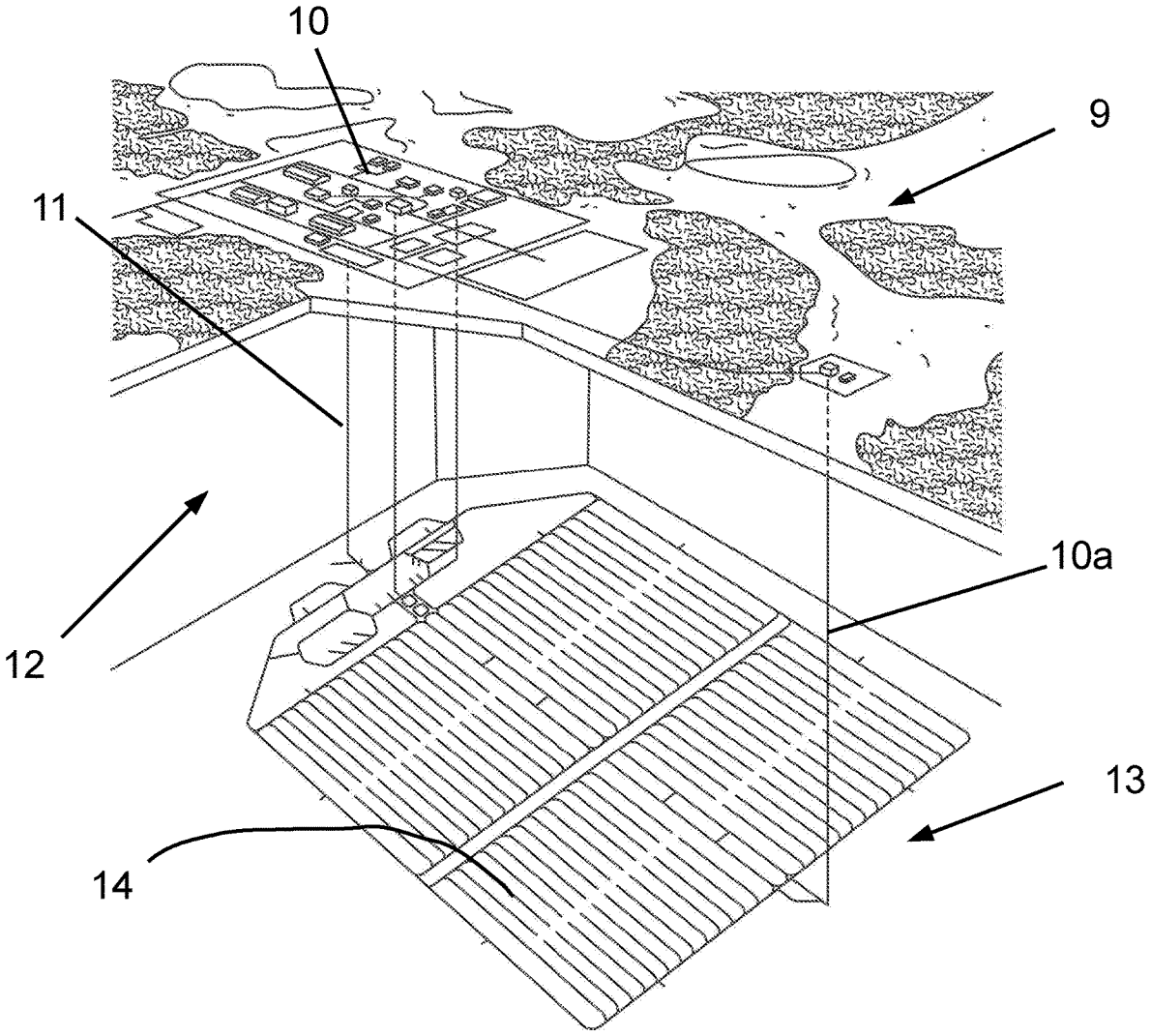
FIG. 2 (Prior Art)
FIG. 2 shows an overview of a prior art underground nuclear waste disposal system as contemplated for Canada.

FIG. 2 illustrates another prior art scheme. FIG. 2 illustrates an inclusive overview of a preferred waste system to be developed in Canada. The FIG. 2 system also derives its origin from a massive mining approach in which a large system of tunnels and emplacements are made in rock 13, about 1,500 feet deep below the surface 9 of the Earth. The estimated cost to construct the waste system is about $24 Billion (USD). The estimated time of construction and emplacement is several decades. As stated by the Canadian Regulatory Agency: "The long-term management of Canada's used nuclear fuel involves the construction of a large, high-technology project that will generate thousands of jobs in the host region and potentially hundreds of jobs in a host community for many decades."

Continuing FIG. 2, the disposal zone 13 is bounded by rock formations 12 above and below the disposal formation 13. Included are surface facilities 10 for managing, protecting, and handling the high-level waste containers. A miniature "city" and operations management complex of the surface facilities 10 are expected to be built to house, feed, protect, and support several thousand individuals working on disposing of the waste material at the remote disposal site. A necessary part of the installation are ventilation shafts 10*a* needed to allow humans to work underground during the emplacement process. It is contemplated that these ventilation shafts 10*a* may be sealed after use or used for monitoring purposes. Transport tunnels 11 (shafts) are needed and implemented to allow entry/egress means of personnel and material to manage the process of disposal. The high-level waste 16 is sequestered in specially made containers which are stored in the emplacement or disposal tunnels 14 which are excavated off the connecting transport tunnels 11. These disposal tunnels 14 or placement rooms 14 are designed to contain the nuclear fuel waste 16 in copper containers encased in a "borehole," which is essentially a short shaft or basement-like void and covered with a protective material such as bentonite. The short shaft may only be between 10 to 30 feet long. The facility is expected to store about 40,000 metric tons of nuclear waste material 16.

Figure 3:
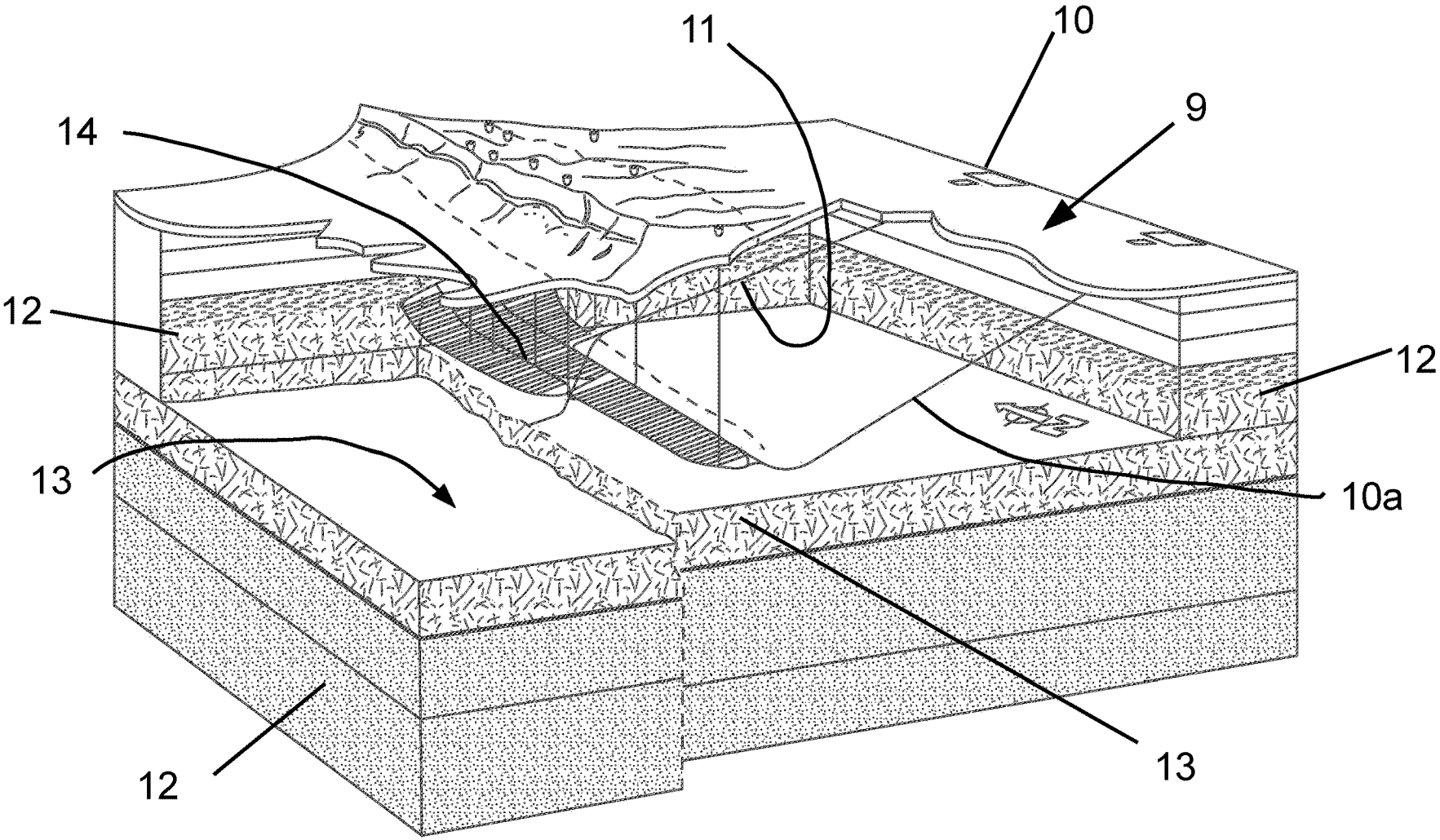
FIG. 3 (Prior Art)
FIG. 3 shows an overview of a prior art underground nuclear waste disposal system as contemplated for Yucca Mountain (Mt.) in the United States (U.S.).

FIG. 3 illustrates another prior art disposal scheme. FIG. 3 illustrates an inclusive overview of a preferred waste system to be developed in the U.S. The FIG. 3 system also derives its origin from a massive mining approach in which a large system of tunnels and emplacements are made in rock 13, only about 400 feet deep below the surface 9 of the Earth and in close contact with the water table in the region. Today (2020), the estimated cost is $37 Billion (USD). The estimated time of construction and emplacement is more than 30 years. Local resistance and lack of political acceptance and political will have put off the system almost indefinitely. As stated by the U.S. Congress in 1992: "Based upon studies by the nation's top scientists, Congress has decided the best solution to the critical problem of spent nuclear fuel (SNF) and high-level radioactive waste (HLW) disposal is to place it in solid rock deep underground." However, the Regulatory Nuclear Agencies went contrary to the stated aim of Congress and decided to follow the mining and near surface approach and recommended Yucca Mt as a site (see e.g., FIG. 3) for permanent nuclear waste storage.

Continuing discussing FIG. 3, the Yucca Mt. disposal zone 13 is bounded by shallow rock formations 12 above and below the disposal formation 13. Included are surface facilities 10 for managing and handling the high-level waste containers. An operations management system, complex and apparatus, of surface facilities 10, are expected to be built to house, protect, and support several hundred individuals on the surface 9 and underground, working on disposing of the waste material 16 at the remote disposal site. A necessary part of the installation are ventilation shaft 10*a* needed to allow humans to work underground during the emplacement process. It is contemplated that these ventilation shafts 10*a* may be sealed after use or used for monitoring purposes. Transport tunnels 11 (shafts) are needed and implemented to allow entry/egress means of personnel and material to manage the process of disposal. The high-level waste 16 is sequestered in specially made containers which are stored in the emplacement or disposal tunnels 14 which are excavated off the connecting transport tunnels 11 in both horizontal and vertical directions. These disposal tunnels 14 are designed to contain the nuclear fuel waste 16 in specialized containers encased in a borehole and covered with a protective material. The boreholes holding the specialized containers are essentially short shafts or basement-like voids (rooms) carved in the floor or sides of the tunnels 14. These "rooms" are small and/or shallow at less than 10 to 20 feet in extent. The contemplated protective material is a complex of extremely expensive titanium shields which is expected to protect the nuclear waste material 16 from the inevitable rainwater expected to percolate down from the surface 9 over time. The facility is expected to dispose (store) about 80,000 metric tons of nuclear waste material 16 (which is grossly inadequate).

Figure 4B:
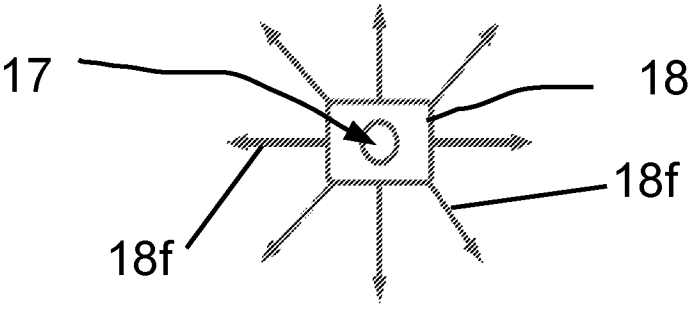
FIG. 4B may depict a top down schematic view of a given walking drill rig, showing possible horizontal/lateral directions that the given walking drill rig may move in and/or over the given grid pattern (e.g., when moving from one drill site to another on the grid pattern).
Figure 4A:
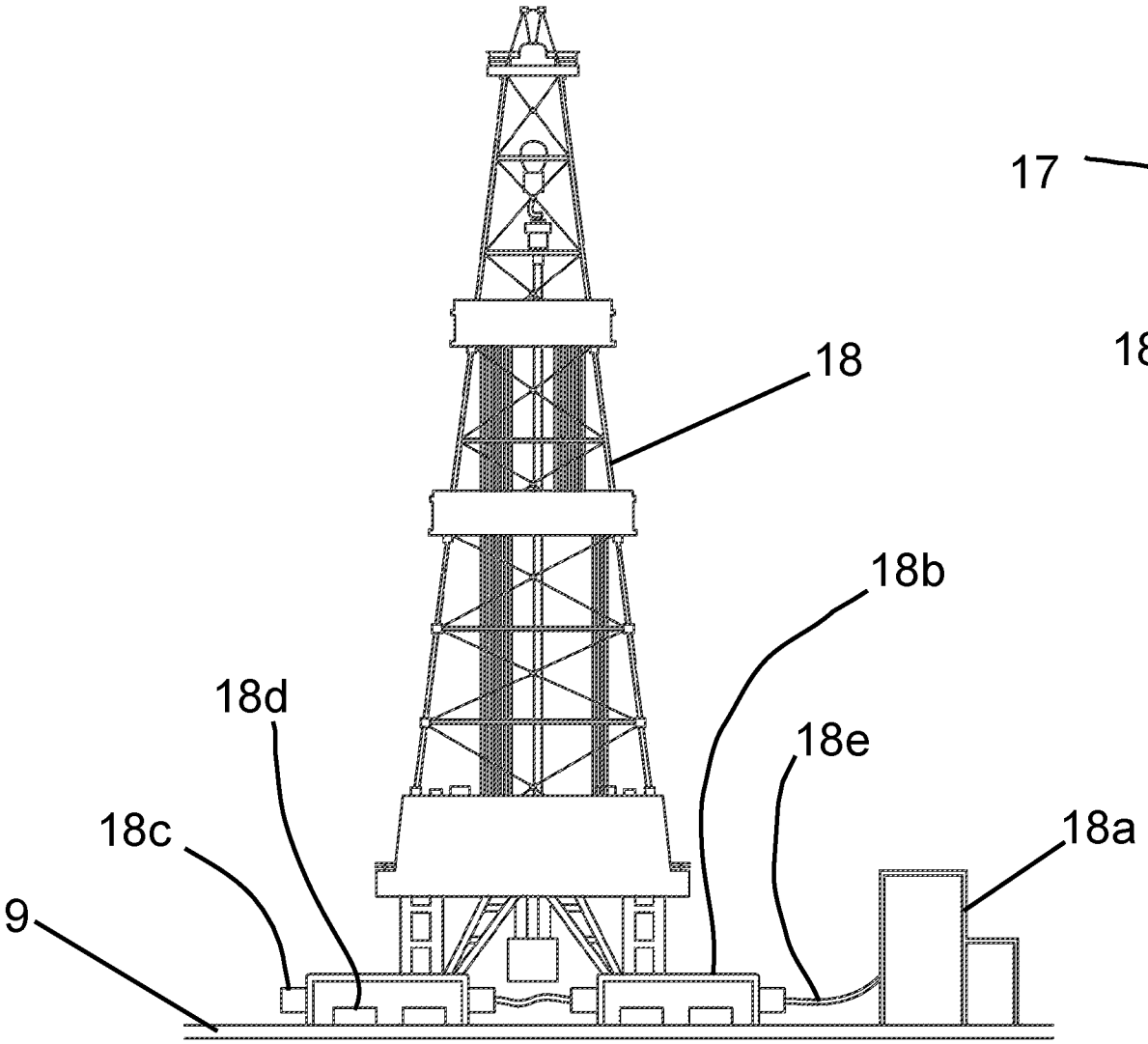
FIG. 4A may be a side view showing a walking drill rig, located on the surface of the Earth and above a deep geological formation, wherein such a walking drill rig may be used to drill multiple wellbores on a given grid pattern that is located above the deep geological formation; and such a walking drill rig may be used to form human-made caverns.

FIG. 4A may show a schematic side view of a specialized walking drilling rig 18 capable of "walking" or "skidding" in one or more directions 18*f* across the surface 9 of the ground. In some embodiments, walking drill rig 18 may comprise a series of operational features which may allow walking drill rig 18 to transverse surface 9 in one or more directions 18*f* as indicated in FIG. 4B.

Continuing discussing FIG. 4A, in some embodiments, walking drill rig 18 may comprise: rig control module(s) 18*a*, rig walking leg(s) 18*b*, horizontal rig mover device(s) 18*c*, vertical rig mover device(s) 18*d*, hydraulic line(s) 18*e*, portions thereof, combinations thereof, and/or the like. In some embodiments, rig control module(s) 18*a* may control (or may allow for control of) movement of walking drill rig 18 via movement control elements, rig walking leg(s) 18*b*, horizontal rig mover device(s) 18*c*, and vertical rig mover device(s) 18*d*; which may further include connected hydraulic line(s) 18*e*. In some embodiments, on initiation, walking drill rig 18 may drill a given vertical wellbore 17 from the surface 9 at a predetermined and/or selected drill site 9*a* location. In some embodiments, a given substantially vertical wellbore 17 may be drilled to a depth of about 3,000 to about 25,000 feet from the given surface 9 drill site 9*a* (i.e., placing distal/terminal portions of the given wellbore 17 into the given deep geological formation 63). In some embodiments, a portion of wellbore 17 may be from about zero (0) degrees to about thirty (30) degrees, plus or minus five (5) degrees, off from true vertical. In some embodiments, one or more drill site 9*a* locations may exist within a predetermined grid pattern 51. In some embodiments, from a given drill site 9*a* location, walking drill rig 18 may drill a given vertical wellbore 17. In some embodiments, once a given vertical wellbore 17 has been drilled to a predetermined depth below surface 9 and to a given disposal formation 63, walking drill rig 18 may then be used to form/create a given human-made cavern 15 (see e.g., FIG. 6 for a human-made cavern 15) via under reaming operations below that given vertical wellbore 17. In some embodiments, on completion of the drilling phase at a given drill site 9*a* location, resulting in at least one vertical wellbore 17 and of the under reaming resulting in at least one human-made cavern 15, the rig control module(s) 18*a* may initiate control of the rig walking leg(s) 18*b*; for example, to move walking drill rig 18 to another (different) drill site 9*a* location. In some embodiments, rig walking leg(s) 18*b* may comprise sub-units horizontal rig mover device(s) 18*c* and/or vertical rig mover device(s) 18*d*; which may allow for (permit) lateral (horizontal) and/or vertical (up-down) rig walking drill rig 18 movements.

Continuing discussing FIG. 4A, in some embodiments, the rig control module(s) 18*a* may initiate and/or control vertical rig mover device(s) 18*d* which may simultaneously raise the walking drill rig 18, under control of the rig control module(s) 18*a*; and then the devices horizontal rig mover device(s) 18*c* may (simultaneously) move the walking drill rig 18 laterally (horizontally/sideways/forwards/backwards) and incrementally a distance at a rate of travel. In some embodiments, the rate of travel for a given walking drill rig 18 may be about two (2) feet per minute, plus or minus thirty (30) seconds. In some embodiments, this dynamic process of walking drill rig 18 lifting and translating may be continued in eight (8) different directions 18*f* (e.g., forwards, backwards, sideways, portions thereof, and/or combinations thereof) on surface 9 as shown in FIG. 4B. By continued walking and drilling operations, walking drill rig 18 may traverse the full areal pattern of the selected drill sites 9*a* to completely develop the desired grid pattern 51 of one or more human-made caverns 15 configured for nuclear waste 16 disposal.

FIG. 4B may illustrate at least some of the various lateral/horizontal directions 18*f* in which the walking drill rig 18 may move across the predetermined grid pattern 51 surface 9 to different drill sites 9*a* on the grid pattern 51. That is, in other words, FIG. 4B may be a top down schematic view of walking drill rig 18 over the given grid pattern 51 of the surface 9. The grid pattern 51 itself may not be shown in FIG. 4B; however, the grid pattern 51 may be shown in FIG. 5, FIG. 7A, and in FIG. 7B. After walking drill rig 18 drills a given vertical wellbore 17, drills a given connector wellbore 17*a*, and/or under-reams a given human-made cavern 15, the walking drill rig 18 may move in multiple directions to restart and continue the drilling and/or reaming operations at other drill sites 9*a* disposed on the given grid pattern 51.

Figure 5:
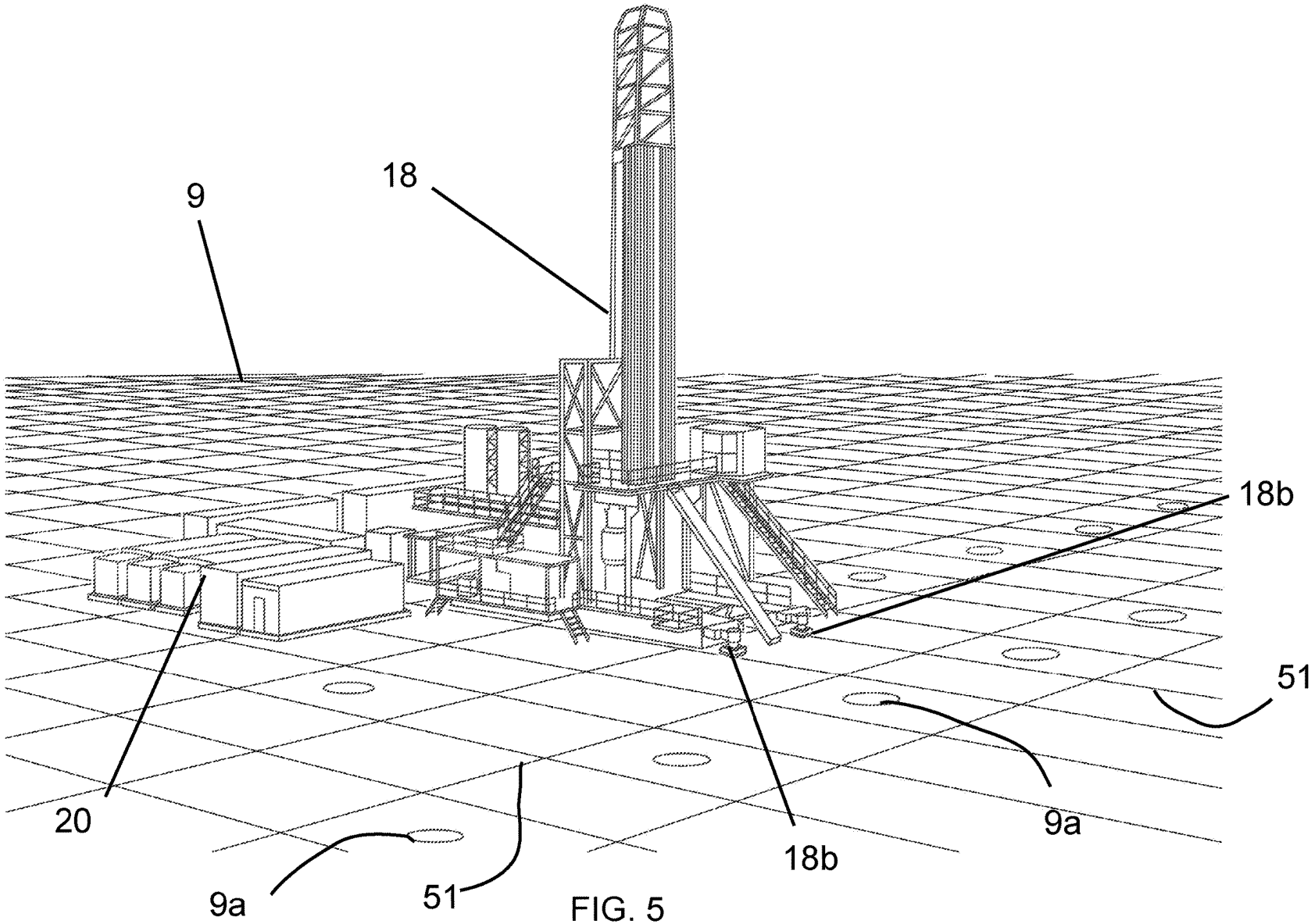
FIG. 5 may depict a perspective view of at least a portion of a given grid pattern made up of a plurality of grids, wherein at least some of those grids may comprise at least one drill site.

FIG. 5 may illustrate walking drill rig 18 and its accessory drilling components situated on a given grid pattern 51 of selected or predetermined drill site 9*a* locations on the surface 9. In some embodiments, a given walking drill rig 18 may comprise at least four (4) rig walking legs 18*b*. In some embodiments, within at least some one grid of a given grid pattern 51 may be at least one drill site 9*a* location. In some embodiments, the walking drill rig 18 may follow the grid pattern 51 on the surface 9 by moving in any of eight (8) or so different directions 18*f* as shown in FIG. 4B.

Continuing discussing FIG. 5, in some embodiments, grid pattern 51 may be not a pattern in the sense of a symmetry. In some embodiments, the "grids" making up a given grid pattern 51 may be not be symmetrical. In some embodiments, not all "grids" making up a given grid pattern 51 may comprise/contain a given drill site 9*a* location. In some embodiments, the "grids" making up a given grid pattern 51 may be of different sizes and/or shapes.

Continuing discussing FIG. 5, in some embodiments, a given grid selected from the grid pattern 51 may have an area that is larger than a cross-section through a given human-made cavern 15 that may be intended to be located below that given grid. For example, and without limiting the scope of the present invention, in some embodiments, a given human-made cavern 15 may have a diameter selected from a range of about twenty-four (24) inches up to about 120 inches, plus or minus six (6) inches. In some embodiments, a given grid selected from a given grid pattern 51 may have dimensions such that the given grid is wider by at least one foot in all horizontal/lateral directions compared to the human-made cavern 15 that may be located (or intended to be located) directly vertically below that given grid. For example, and without limiting the scope of the present invention, if a given human-made cavern 15 has a diameter of ten (10) feet (i.e., 120 inches), then its directly vertically above grid may have dimensions of at least eleven (11) feet in all horizontal/lateral directions of that given grid (e.g., an 11 feet by 11 feet grid). In some embodiments, adjacent grids selected from the grid pattern 51 may each include at least one single drill site 9*a*; and/or a human-made cavern 15 may be located directly vertically beneath each such adjacent grid. Thus, a given grid pattern 51 on surface 9 may comprise a plurality of human-made caverns 15 distributed below surface 9 and below the grid pattern 51, but that plurality of human-made caverns 15 may be distributed in a manner that mirrors and/or mimics the above grid pattern 51, i.e., with one human-made cavern 15 located per each grid what includes a drill site 9*a* (not all grids in the grid pattern 51 may have drill sites 9*a* within). In this manner, the plurality of human-made caverns 15 may be tightly, but safely, packed together below the given grid pattern 51.

Continuing discussing FIG. 5, in some embodiments, grid pattern 51 may comprise at least one drill site 9*a* location. In some embodiments, grid pattern 51 may comprise one or more drill site 9*a* locations. In some embodiments, grid pattern 51 may comprise at least two drill site 9*a* locations. In some embodiments, grid pattern 51 may comprise a plurality of site 9*a* locations. In some embodiments, a given grid selected from the grid pattern 51 may comprise at least one drill site 9*a* location. In some embodiments, not all grid(s) selected from the grid pattern 51 may comprise a drill site 9*a* location. In some embodiments, a given drill site 9*a* location may be a location on surface 9 wherein walking drill rig 18 (or the like) may operate from, at and/or on. In some embodiments, a given drill site 9*a* location may be a location on surface 9 wherein drilling operations, under-reaming operations, pumping operations, loading/inserting/landing operations, retrieval operations, maintenance operations, combinations thereof, and/or the like may occur from. In some embodiments, directly (vertically) below a given drill site 9*a* location may be one or more of: wellbore 17, connector wellbore 17*a*, human-made-cavern 15, nuclear waste material 16, protective blanket 16*a*, wellbore casings (piping), portions thereof, combinations thereof, and/or the like. For example, and without limiting the scope of the present invention, in some embodiments, from a given drill site 9*a* location, a given walking drill rig 18 may: drill at least one vertical wellbore 17 and may under-ream a terminal portion of a given vertical wellbore 17 to form a given human-made cavern 15; or drill a given connector wellbore 17*a* (see FIG. 7B for a connector wellbore 17*a*).

Continuing discussing FIG. 5, in some embodiments, drill rig support building(s) 20 may also exist on surface 9, either on, adjacent to, and/or proximate to the given grid pattern 51. In some embodiments, the drilling rig support building 20 may house a set of monitoring instruments, drilling systems, down-hole logging tools, readout displays and communications equipment to allow overall control of the wellsite, portions thereof, combinations there, and/or the like. In some embodiments, the drilling rig support building 20 may house drilling personnel and/or staff onsite to allow 24-hour operations of drilling activity.

Note, while FIG. 5 only shows one walking drill rig 18, some embodiments of the present invention do contemplate using one or more walking drill rigs 18.

Figure 6:
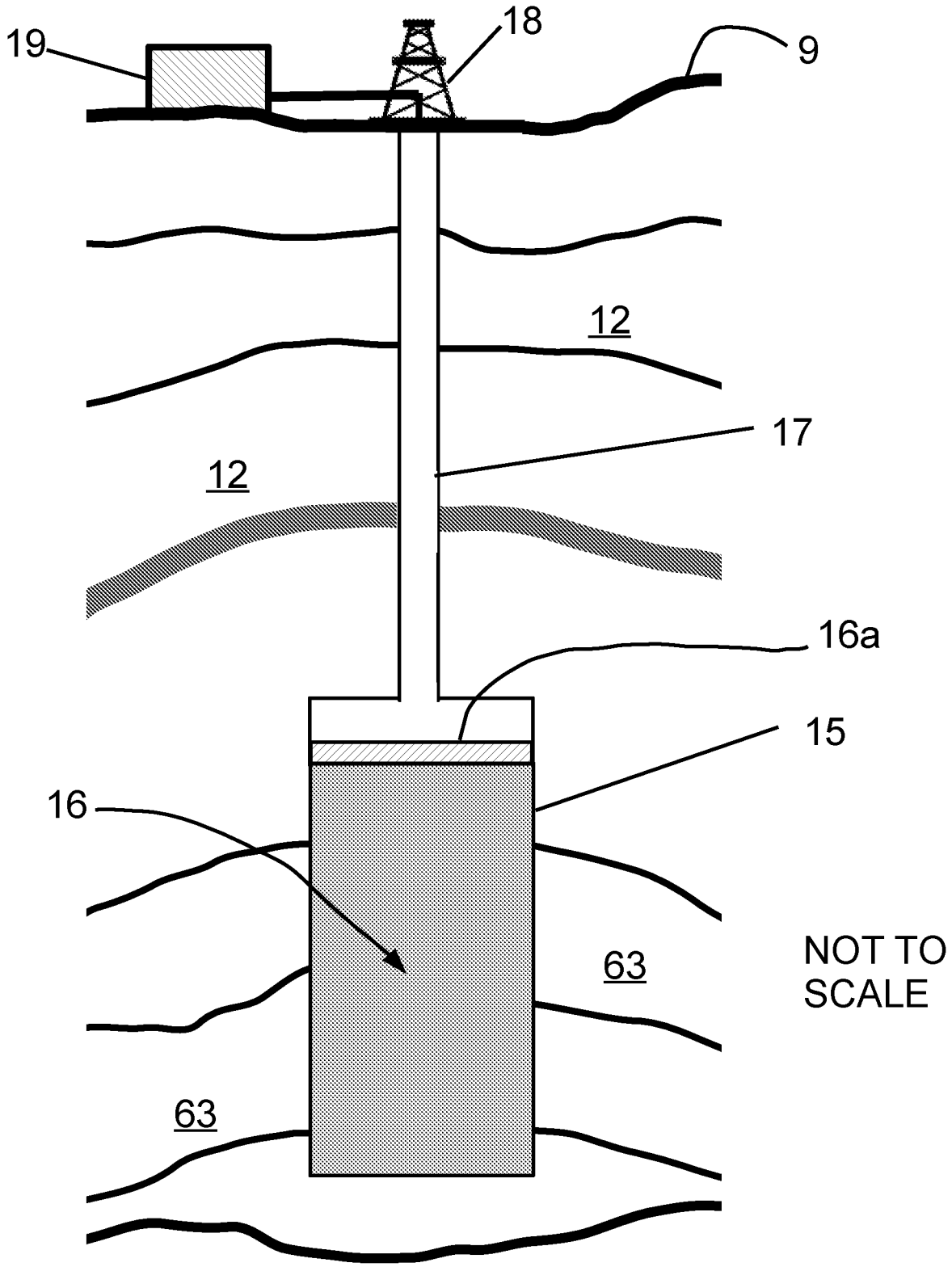

FIG. 6 may illustrate a cross-section of an embodiment in which at least one nuclear waste disposal human-made cavern 15 is implemented in the given deep geological rock formation 63 (host rock 63). (In some embodiments, a given human-made cavern 15 may be referred to as a "Super-SILO™.") In this embodiment, human-made cavern 15 may be intentionally created, formed, and drilled out from a given wellbore 17. In some embodiments, this wellbore 17 may be initially drilled vertically from the Earth's surface 9. In some embodiments, under reaming operations may be formed at terminal/distal portions of a given wellbore 17 to form a given human-made cavern 15. In some embodiments, a given human-made cavern 15 is made by under-reaming at least some portion(s) of the wellbore 17. In some embodiments, a given human-made cavern 15 may have a diameter selected from a range of about twenty-four (24) inches up to about 120 inches, plus or minus six (6) inches.

Further illustrated in FIG. 6 is nuclear waste 16 which may be placed (disposed of) in the human-made cavern 15 from surface 9. In some embodiments, the internal volume of a given human-made cavern 15 may be at least partially filled with nuclear waste material 16. In some embodiments, the internal volume of a given human-made cavern 15 may collect a predetermined amount of nuclear waste material 16.

Continuing discussing FIG. 6, in some embodiments, a protective blanket (material) 16*a* may be implemented above a top of the nuclear waste material 16 in the given human-made cavern 15. In some embodiments, protective blanket (material) 16*a* may be delivered to the given human-made cavern 15 via that human-made cavern 15's attached wellbore 17. In some embodiments, protective blanket (material) 16*a* may be selected from one or more of: bentonite, bentonite mud, bitumen, heavy oils, cement slurries, heavy oils, emulsions, nanotubes, portions thereof, combinations thereof, and/or the like. In some embodiments, the protective blanket 16*a* may be integral part of the physical systems which are necessary and/or desired to mitigate migration of dangerous radionuclides away from the disposal site. In some embodiments, materials like bentonite clays, heavy oils, portions thereof, combinations thereof, and/or the like may form at least a portion of protective blanket 16*a*. In some embodiments, protective blanket 16*a* may (naturally/passively) absorb the radionuclide material, the blanket behaving, like a gel, may also provide a very low permeability flow barrier such that very little if any flow occurs across the blanket zone and away from the radioactive waste source material 16, in effect trapping the radionuclides inside the waste zone 16. In some embodiments, the protective blanket 16*a* may effectively protect the outside environment from the radioactive materials 16 by confining the waste 16 and preventing the potential for material 16 transport away from the cavern 15 system.

Continuing discussing FIG. 6, in some embodiments, the given deep geological rock formation 63 (host rock 63 or disposal formation 63) may be one or more of: impermeable sedimentary rock, very low permeability sedimentary rock, impermeable metamorphic rock, very low permeability metamorphic rock, impermeable igneous rock, very low permeability ingenious rock, portions thereof, combinations thereof, and/or the like. "Impermeable" in this context may be with respect to water migration and/or with respect to radionucleotide migration. "Impermeable" may be having permeability measurements less than 10 nanodarcy. "Very low permeability" in this context may be with respect to water migration and/or with respect to radionucleotide migration. "Very low permeability" may be having permeability measurements between 10 and 1,000 nanodarcy. In some embodiments, deep geological rock formation 63 (host rock 63 or disposal formation 63) may be subterranean (underground), located at least 2,000 feet to 30,000 feet below an Earth surface 9, plus or minus 1,000 feet.

Note, deep geological rock formation 63 (host rock 63 or disposal formation 63) has very different characteristics and properties as compared to the prior art's disposal formations 13.

Continuing discussing FIG. 6, upon the surface 9 may be surface operations equipment/structures 19, drill rig support buildings 20 as shown in FIG. 5; wherein surface operations equipment/structures 19 and/or drill rig support buildings 20 may be located near to, next to, adjacent to, proximate to, the given walking drill rig 18. In some embodiments, walking drill rig 18 may be substantially as drilling rigs used in oilfield operations; however, 18 may have some modifications, such as, but not limited to shielding to minimize exposure to radiation.

Continuing discussing FIG. 6, in some embodiments, at least one wellbore 17 may extend into the deep geological rock formation 63 (host rock 63). In some embodiments, the at least one wellbore 17 may be configured to receive the at least one unit of nuclear waste 16. In some embodiments, the at least one well-bore 17 may be formed from walking drill rig 18 drilling operations at a given drill site 9*a* location. In some embodiments, the at least one wellbore 17 may be drilled from an Earth surface 9 location of a given drill site 9*a*. In some embodiments, the at least one wellbore 17 may be comprised of at least one substantially vertical section (generally denoted with reference numeral "17"). In some embodiments, a distal/terminal end of the at least one wellbore 17 may terminate at a beginning of the at least one substantially vertical human-made cavern 15. In some embodiments, a distal end of the at least one wellbore 17 may terminate at an entrance to at least one human-made cavern 15, wherein the at least one human-made cavern 15 may be located within the deep geological rock formation 63 (host rock 63). In some embodiments, the at least one wellbore 17 may have at least one diameter that is drilled at a particular and predetermined size. In some embodiments, wellbore 17 may have different diameters, but each different diameter may be of a fixed size. In some embodiments, a diameter of wellbore 17 may be from 10 inches to 48 inches, plus or minus 6 inches. In some embodiments, the at least one wellbore 17 may have a length from 3,000 feet to 30,000 feet, plus or minus 1,000 feet (which may place distal/terminal portions of the given substantially vertical wellbore 17 into the deep geological formation 63). In some embodiments, a distal end of away from an Earth surface 9 location of the at least one wellbore 17 may be a final depository location for some nuclear waste 16 products. In some embodiments, the at least one wellbore 17 may be a transit means (route) configured for transit of nuclear waste material 16 through the at least one wellbore 17.

Continuing discussing FIG. 6, in some embodiments, the at least one human-made cavern 15 may be substantially cylindrical in shape. In some embodiments, a length of human-made cavern 15 may be substantially parallel with the substantially vertical section of wellbore 17. In some embodiments, a length of human-made cavern 15 may be substantially parallel with the substantially vertical section of wellbore 17. In some embodiments, the at least one human-made cavern 15 may have a volume that may be fixed and predetermined, wherein each human-made cavern 15 volume may be selected from the range of about 35,000 cubic feet to about 384,000 cubic feet for a given at least one human-made cavern 15, plus or minus 5,000 cubic feet. See e.g., Table 1. In some embodiments, the at least one human-made cavern 15 may be a final depository location for disposal/storage of at least some nuclear waste material 16. In some embodiments, the at least some waste material 16 (with at least some nuclear waste in some embodiments) may be received into the at least one human-made cavern 15.

Continuing discussing FIG. 6, in some embodiments, each human-made cavern 15 selected from the plurality of human-made caverns 15 may have a predetermined diameter and a predetermined length (which may yield the predetermined volume). In some embodiments, the predetermined diameter for a given human-made cavern 15 may be selected from a range of twenty-four (24) inches to 120 inches, plus or minus six (6) inches; wherein the predetermined length for a given human-made cavern 15 may be selected from a range of 500 feet to 10,000 feet, plus or minus 100 feet. In some embodiments, the predetermined diameter and/or the predetermined length of one human-made cavern 15 selected from the plurality of human-made caverns 15 may be different from the predetermined diameter and/or the predetermined length of another human-made cavern 15 selected from the plurality of human-made caverns 15. In some embodiments, this may be so, to accommodate nuclear waste 16 of a particular format (e.g., slurry versus brick) into a given human-made cavern 15 (see e.g., FIG. 7A and/or FIG. 7B); and/or this may be so because of differences in geometry of the given deep geological formation 63 that is housing the plurality of human-made caverns 15.

Figure 7A:
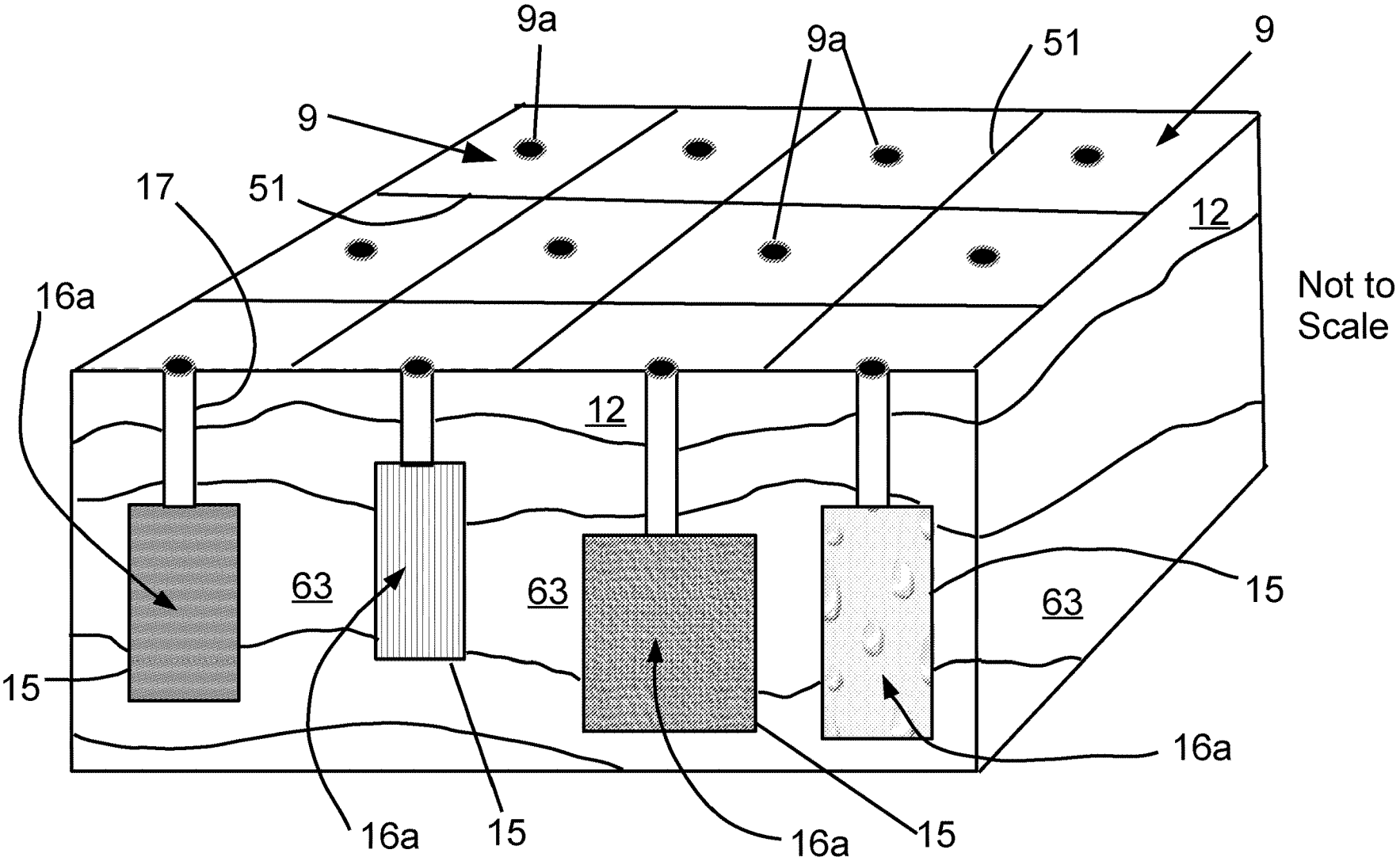
FIG. 7A may depict a portion of grid pattern and a portion of a deep geological formation disposed vertically below the grid pattern, shown from a cross-sectional perspective view, wherein at least some of the drill sites located in the grids of the grid pattern may be connected via substantially vertical wellbores to human-made caverns located below the grid pattern.

FIG. 7A may illustrate a three-dimensional (3D) cross-section of an embodiment in which at least one nuclear waste disposal human-made cavern 15 is implemented in the given deep geological rock formation 63 (host rock 63) and below the grid pattern 51. FIG. 7A may illustrate a three-dimensional (3D) cross-section of an embodiment in which at least two nuclear waste disposal human-made caverns 15 are implemented in the given deep geological rock formation 63 (host rock 63) and below the grid pattern 51. In such embodiments, human-made caverns 15 are intentionally created, formed, drilled out, and/or under reamed from given wellbores 17, below given drill sites 9*a*, under/within the given grid pattern 51. In some embodiments, a distal/terminal portion of a given wellbore 17, which is initially drilled vertically from the earth's surface 9 using walking drill rig 18 (or the like), may be under-reamed to form a given human-made cavern 15. In some embodiments, a human-made cavern 15 is made by under-reaming at least some portion(s) of a given wellbore 17.

Further illustrated in FIG. 7A is nuclear waste 16 which may be placed within a given human-made cavern 15 from surface 9, using wellbore 17 to reach the given human-made cavern 15, and using walking drill rig 18 (or the like). In some embodiments, a series of human-made caverns 15 may be implemented in the disposal formation 63 in grid pattern 51 (or portion thereof), by drilling and under reaming operations from the surface 9 using wellbore(s) 17 to reach the given human-made cavern(s) 15, and using at least one walking drill rig 18 (or the like). In some embodiments, two or more drill sites 9*a*, selected from within the given grid pattern 51, may provide the surface locations from which vertical wellbores 17 may be drilled into the host formation 63 and then the terminal/distal portions under-reamed to form a grid of human-made caverns 15 below grid pattern 51. In some embodiments, walking drill rig 18 may move from one drill site 9*a* location to another drill site 9*a* location, to develop the patterned grid of human-made caverns 15 below the surface 9 and below grid pattern 51.

Continuing discussing FIG. 7A, in some embodiments, the human-made caverns 15 may be implemented at different vertical depths from the surface 9 in the host formation 63. In some embodiments, these human-made caverns 15 may each be of a different size and/or volumes (capacity) depending on these human-made cavern's 15 physical dimensions (e.g., cavern length and/or diameter); which in turn may facilitate disposal of varying types and/or differing volumes of nuclear waste material 16. In some instances, because of the differing types and/or differing contents of the nuclear waste materials 16 therein, these different human-made caverns 15 may be conditioned differently and/or independently from each other, as explained below (see e.g., step 807 of method 800 in FIG. 8A). In some embodiments, FIG. 7A may show that different types of immersive protective mediums 16*b* may be used in the given human-made caverns 15 to immerse, cover, mix, protect, and seal the nuclear waste material 16 residing therein. In some embodiments, the immersive protective medium 16*b* may function differently from the protective blanket 16*a* which may be localized at a top of the given waste human-made cavern 15.

It is contemplated that different types of immersive protective mediums 16*b* may be utilized for different types of waste materials 16. Examples of immersive protective mediums 16*b* may be one or more of: bitumen, tars, heavy oils, cement slurries, bentonite clays, bentonite gels, other radionuclide absorbing materials, portions thereof, combinations thereof, and/or the like. In some instances, if a cement-like slurry were used as an immersive protective medium 16*b*, such a cement slurry on setting in the given human-made cavern 15 may bind with the waste material 16 (that is also inside of the given human-made cavern 15) to form what may be essentially and/or substantially a human-made conglomerate rock mass. In some embodiments, the human-made caverns 15 shown in FIG. 7A may contain predetermined amounts of the nuclear waste materials 16. In some embodiments, reference numeral 16*a* may designate both a given immersive protective medium and nuclear waste materials 16. In some embodiments, the different shadings within the human-made caverns 15 of FIG. 7A may be for setting forth immersive protective mediums 16*b* of different types.

Figure 7B:
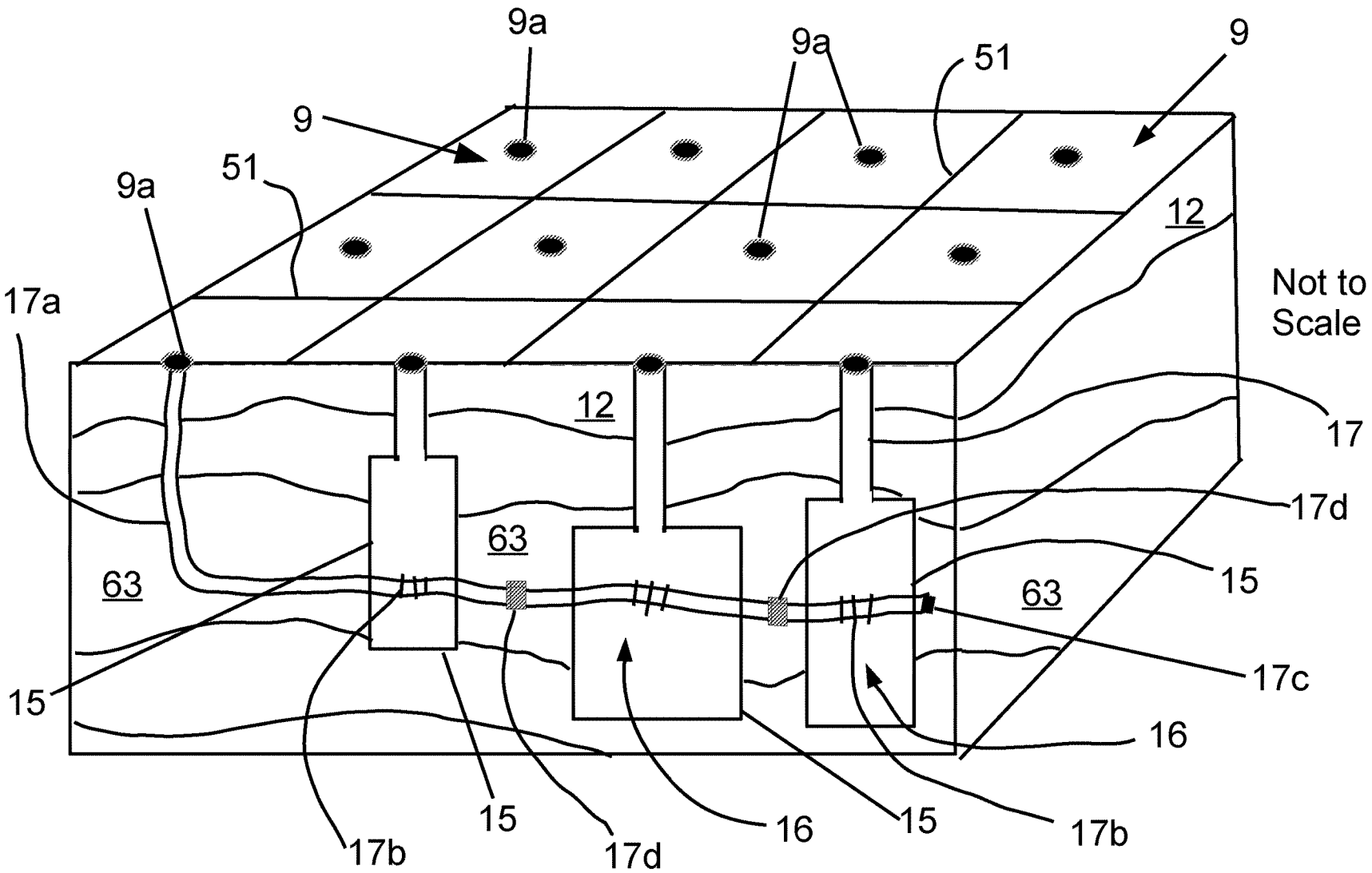
FIG. 7B may depict a portion of grid pattern and a portion of a deep geological formation disposed vertically below the grid pattern, shown from a cross-sectional perspective view, wherein at least some of the drill sites located in the grids of the grid pattern may be connected via substantially vertical wellbores to human-made caverns located below the grid pattern; wherein FIG. 7B may also show a connector wellbore originating from the surface of the Earth and then intersecting/piercing some of the human-made caverns.

FIG. 7B may illustrate a three-dimensional (3D) cross-section of an embodiment in which at least one nuclear waste disposal human-made cavern 15 is implemented in the given deep geological rock formation 63 (host rock 63) and below the grid pattern 51. FIG. 7B may illustrate a three-dimensional (3D) cross-section of an embodiment in which at least two nuclear waste disposal human-made caverns 15 are implemented in the given deep geological rock formation 63 (host rock 63) and below the grid pattern 51. In such embodiments, human-made caverns 15 are intentionally created, formed, drilled out, and/or under reamed from wellbores 17. In some embodiments, at least some (one) wellbores 17 may be initially drilled vertically from the earth's surface 9, using walking drill rig 18 (or the like), may allow (distal and/or terminal portions/regions of) wellbores 17 to be under-reamed to form the given human-made caverns 15. In some embodiments, a given human-made cavern 15 may be made by under-reaming at least some portion(s) of the vertical wellbore 17.

Further illustrated in FIG. 7B is nuclear waste material 16 which may be placed in (located within) the human-made caverns 15 from surface 9 (e.g., by using walking drill rig 18 [or the like] and wellbores 17).

Continuing discussing FIG. 7B, in some embodiments, a series (plurality) of human-made caverns 15 may be implemented in the disposal formation 63 in (and below) grid pattern 51, by drilling and reaming operations from the surface 9 (e.g., by using walking drill rig 18 [or the like] and wellbores 17). In some embodiments, each drill site 9*a* location on surface 9 within grid pattern 51 may provide the surface location from which a vertical wellbore 17 may be drilled into the host formation 63 and then under-reamed to form a grid of human-made caverns 15, wherein each such human-made cavern 15 may receive at least some nuclear waste material 16 for disposal/storage. In some embodiments, one or more walking drill rig(s) 18 may move from drill site 9*a* location to another drill site 9*a* location to develop grid pattern 51 of two or more human-made caverns 15 below the surface 9.

Continuing discussing FIG. 7B, in some embodiments, a connector wellbore 17*a* may be drilled from the surface 9 (e.g., from a given drill site 9*a* location) to intersect at least one of the human-made caverns 15 at a location between a top and a bottom of the given human-made cavern 15 being intersected. In some embodiments, a given connector wellbore 17*a* may be drilled from surface 9, but outside of the grid pattern 51 and into a given human-made cavern 15 that is located below the grid pattern 51. In some embodiments, connector wellbore 17*a* may be drilled and cased with pipes (casings). In some embodiments, such casings (piping) may be substantially constructed from steel or the like. In some embodiments, connector wellbore 17*a* may have both (substantially) vertical and (substantially) horizontal (lateral) portions. In some embodiments, connector wellbore 17*a* may penetrate and/or intersect at least one human-made caverns 15. In some embodiments, connector wellbore 17*a* may penetrate and/or intersect two or more human-made caverns 15. In some embodiments, connector wellbore 17*a* may penetrate and/or intersect two or more adjacent human-made caverns 15. In some embodiments, connector wellbore 17*a* may penetrate through the walls and across several human-made caverns 15 using available geo-steering techniques for lateral drilling and downhole perforation "guns" for perforating the walls, wellbores, and/or casings. In some embodiments, a diameter of a given connector wellbore 17*a* may be between four (4) inches and twelve (12) inches, plus or minus one (1) inch. In some embodiments, the portion(s) of a given connector wellbore 17*a* that may be intersect and/or pierce a given human-made cavern 15 may be substantially lateral/horizontal. In some embodiments, a given connector wellbore 17*a* may intersect and/or pierce a given human-made cavern 15 at a middle of that given human-made cavern 15. In some embodiments, a given connector wellbore 17*a* may intersect and/or pierce a given human-made cavern 15 above a middle of that given human-made cavern 15. In some embodiments, a given connector wellbore 17*a* may intersect and/or pierce a given human-made cavern 15 in an upper region of that given human-made cavern 15.

Continuing discussing FIG. 7B, in some embodiments, connector wellbore 17*a* may comprise one or more regions of perforations 17*b*. In some embodiments, the one or more regions of perforations 17*b* in a given connector wellbore 17*a* may be located within human-made caverns 15 that are intersected by that given connector wellbore 17*a*. In some embodiments, a given connector wellbore 17*a* may be perforated 17*b* at location(s) in a given human-made cavern 15 that is intersected by the given connector wellbore 17*a*, such that fluid connectivity may be achieved between the surface 9, the connector wellbore 17*a* and the specific human-made cavern 15 internal volume, into which fluid communication may be needed and/or desired. In some embodiments, this fluid connectivity feature may allow for injection (and/or withdrawal) of fluids and pumpable material(s), which may form a distributed, immersive protective medium 16*b* throughout the waste material 16 disposed in the given human-made cavern 15, from the surface 9 to the intersected human-made caverns 15 with perforations 17*b* using the given connector wellbore 17*a*.

Continuing discussing FIG. 7B, in some embodiments, a specialized downhole packer device or "isolation" packer 17*d* may be installed inside the connector wellbore 17*a* between consecutive human-made cavern 15 locations, that have been intersected with the given connector wellbore 17*a*, to shut off (or open) communication (e.g., flow) between the respective human-made caverns 15 during injection operations through the given connector wellbore 17*a*. In some embodiments, connector wellbore 17*a* may comprise one or more down hole flow-control packer 17*d* devices. In some embodiments, within connector wellbore 17*a*, the one or more down hole flow-control packer 17*d* devices may be located between human-made caverns 15 that have been intersected by the given connector wellbore

17*a*. In some embodiments such specialized packer(s) 17*d* may be retrievable packer, i.e., the packer device 17*d* may be installed and removed as needed in the given connector wellbore 17*a*. In some embodiments, the packer 17*d* may be a flow-thru device which may allow fluids to flow through the device 17*d* when the device is in the open position. In some embodiments, the packer 17*d* may be a flow-control device which may allow fluids to flow through the device 17*d* when the device is in the open position. In some embodiments, in the closed position of a given packer 17*d*, no flow is allowed across and/or through the packer 17*d*. In some embodiments, a given packer 17*d* may have at least two operational configurations, open and closed; wherein in the open configuration fluid flow may be permitted through and/or across the given packer 17*d*; wherein in the closed configuration, fluid flow is stopped from flowing through and/or across the given packet 17*d*. In some embodiments, the open configuration of a given packer 17*d* may be variable, such as, but not limited to, high flow, medium flow, low flow, combinations thereof, and/or the like.

Continuing discussing FIG. 7B, in some embodiments, a plug 17*c* device may be installed at a terminal end of the connector wellbore 17*a*. In some embodiments, connector wellbore 17*a* may comprise at least one plug 17*c*. In some embodiments, at least one plug 17*c* may be located at a distal/terminal end of connector wellbore 17*a*, disposed away from the drill site 9*a* wherein the given connector wellbore 17*a* was drilled from. In some embodiments, plug 17*c* may seal off (close) the given connector wellbore 17*a*. In some embodiments, a given plug 17*c* may prevent loss of fluid(s) which may be injected into the connector wellbore 17*a* and into the human-made caverns 15 intersected by that connector wellbore 17*a*.

In some embodiments, FIG. 4A through FIG. 7B may shows systems and/or components of systems for nuclear waste disposal using a geologically deep array/grid of human-made caverns 15.

In some embodiments, developing the deep disposal array of a plurality of human-made caverns 15 (configured for receiving nuclear waste materials 16) over the disposal area of the given grid patter 51 may be relatively inexpensive, i.e., tens of millions of dollars, as compared to the billions of dollars envisaged for development of the mining type disposal systems in the prior art.

For example, and without limiting the process discussed herein, drilling and completing a single pilot wellbore 17 and human-made cavern 15 may cost between $5,000,000 and $10,000,000 depending on the size (diameter) of the human-made cavern 15 and the length (height) of the human-made cavern 15 and the depth of the host rock 63. A 5,000 feet deep system may cost less than $10,000,000. Thus, development of an array of twenty (20) human-made caverns 15 may cost only $200 million, a figure that is less than 5% of the cost projected for the smallest prior art mining solutions for nuclear disposal. This cost comparison vis-a-vis the prior art is at least one significant benefit of the new embodiments described herein.

For example, and without limiting the scope of the present invention, a system for nuclear waste disposal using a geologically deep array/grid of human-made caverns 15 implemented in rock formation at 5,000 feet deep, notably, significantly deeper than any prior art mining method, and using at least one walking drill rig 18, there may be only one mobilization cost and de-mobilization cost regardless of the number of wellbores 17 and/or human-made caverns 15 drilled and completed. Thus, there is a significant decrease in overall cost for such embodiments.

A further significant benefit of embodiments of the present invention maybe the greatly reduced times needed to drill and complete the human-made cavern 15 system over the design grid pattern 51 array. For example, and without limiting the scope of the present invention, drilling and completing a 5,000 foot, single well 17/cavern 15 system may be implemented in a time period between 50 and 70 days. A significant time improvement over the times of years or even decades needed to prepare the mines and tunnels for the prior art disposal methods.

Figure 8A:
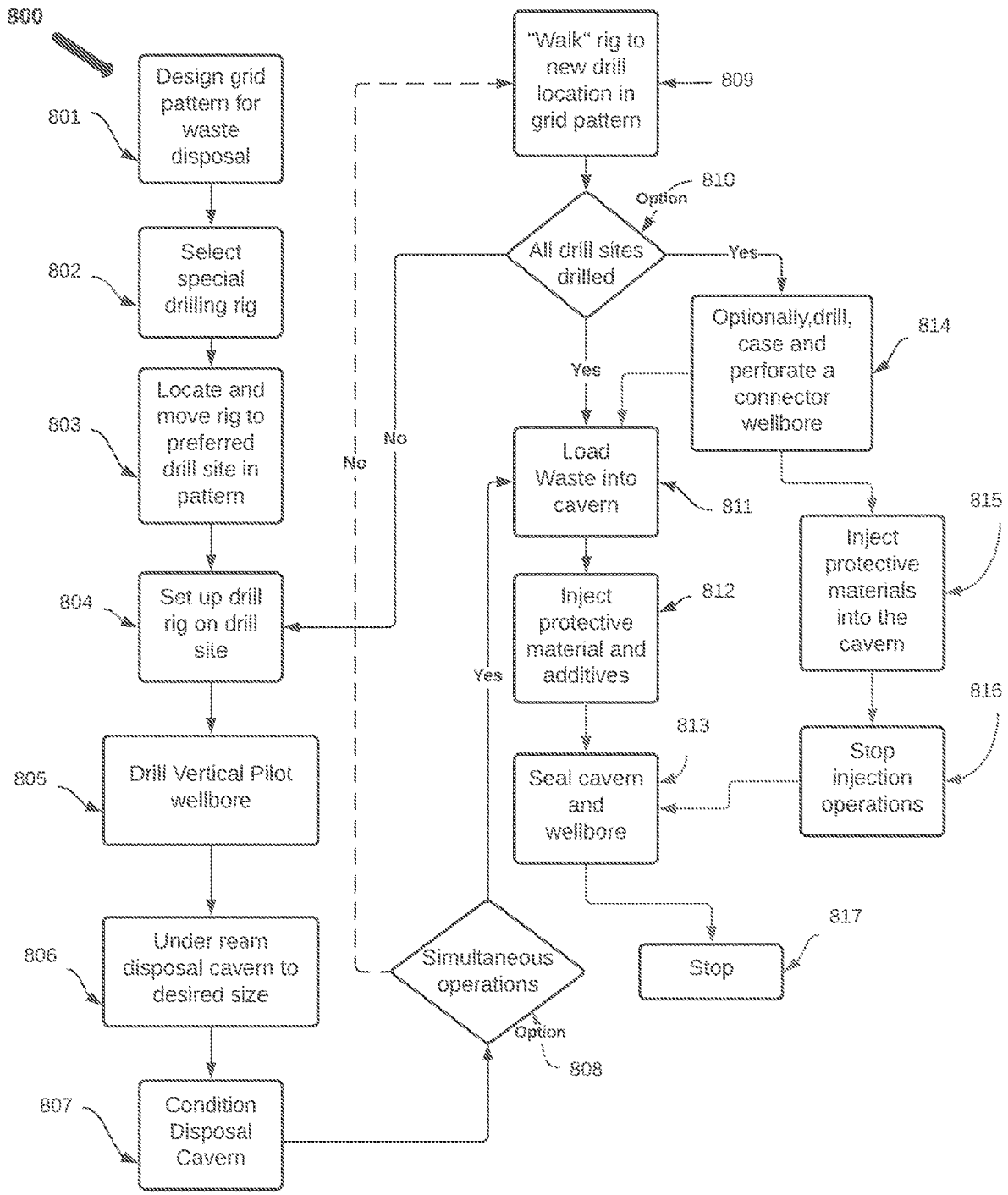
FIG. 8A may depict at least some steps in a method of disposing of nuclear waste materials using human-made caverns arranged in a gridded pattern.

In some embodiments, the systems for nuclear waste disposal using a geologically deep array/grid of human-made caverns 15 and/or components thereof shown in FIG. 4A through FIG. 7B may be used to implement various methods for nuclear waste disposal using the geologically deep array/grid of human-made caverns 15, see e.g., FIG. 8A and its discussion.

FIG. 8A may illustrate a flow chart of a method 800 for implementing a gridded system of deep subterranean human-made caverns 15 for the disposal of dangerous waste materials 16. FIG. 8A may depict at least some steps of method 800. In some embodiments, method 800 may be a method of designing, implementing, and/or using a grid pattern 51 on the surface 9 with a plurality of drill holes 9*a* from and below which, are made a plurality of human-made caverns 15 located deep in a geological formation 63 by utilization of a self-propelled walking drill rig 18, wherein the plurality of human-made caverns 15 are configured for receiving dangerous waste materials 16. In some embodiments, method 800 may be a method for nuclear waste 16 disposal using the geologically deep array/grid of human-made caverns 15. In some embodiments, method 800 may be a method for utilizing a self-propelled walking drilling rig 18 capable of lateral, horizontal, vertical, and translational movement across the surface 9 to drill at a plurality of drill sites 9*a*. In some embodiments, the plurality of drill sites 9*a* may be disposed of (located) within a surface 9 grid pattern 51. In some embodiments, the plurality of drill sites 9*a* may be located within at least some of the grids of the grid pattern 51. In some embodiments the walking drill rig 18 may be capable of drilling a vertical wellbore 17 and reaming out a human-made cavern 15 below the vertical wellbore 17 from any given drill site 9*a*. In some embodiments the walking drill rig 18 may be capable of drilling connector wellbore(s) 17*a* from at least some of the drill sites 9*a*.

Continuing discussing FIG. 8A, in some embodiments, method 800 may comprise at least one step selected from steps of: 801, 802, 803, 804, 805, 806, 807, 808, 809, 810, 811, 812, 813, 814, 815, 816, 817, portions thereof, combinations thereof, and/or the like. Some embodiments of method 800 may omit one or more of these steps. Some embodiments of method 800 may be one or more decision steps (e.g., steps 808 and 810). Some embodiments of method 800 may repeat at least one of these steps (e.g., because more than one human-made cavern 15 may be formed according to method 800). In some embodiments, the order of the steps in method 800 may not occur in numerical order.

Continuing discussing FIG. 8A, in some embodiments, step 801 may be a step of defining and/or analyzing operational parameters, land, geology, accessibility features, necessary to provide the design, layout, and/or physical dimensions associated with the human-made cavern 15 implementation methods and techniques. In some embodiments, outputs of this step 801, may be plans of: showing the layout of the grid pattern 51; drill sites 9*a* layouts/distributions; which drill sites 9*a* may be for wellbores 17 and/or for human-made caverns 15; which drill sites 9*a* may be for connector wellbores 17*a*; which human-made caverns 15 may be connected by a given connector wellbore 17*a*; quantity and types of drilling, under-reaming equipment (walking drill rig(s) 18); sequence of drill sites 9*a* to be worked (e.g., by a given walking drill rig 18); walking drill rig(s) 18 movement plans; quantity, types, and locations of surface operations equipment/structures 19 and/or drill rig support buildings 20; aerial distribution plans; survey results; quantity and types of personnel; portions thereof; combinations thereof; and/or the like. In some embodiments, surface 9 of a given grid pattern 51 may comprise from about 20 acres and to about 100 acres, plus or minus 5 acres. Note, even at 100 acres of a given grid pattern 51, this is significantly smaller than the acreage needed for the prior art methods. In some embodiments, grid pattern 51 may be of a quantity of predetermined acres (that may be less than 20 acres or more than 100 acres in some embodiments). In some embodiments, step 801 may be a step of forming a predetermined grid pattern 51 on a surface 9 of the Earth that may be (substantially) vertically directly above at least one deep geological formation 63, wherein the predetermined grid pattern 51 may comprise a plurality of grids, wherein a sub-set of the plurality of grids may comprise at least one drill site 9*a* per grid selected from the sub-set. In some embodiments, step 801 may progress into step 802.

Continuing discussing FIG. 8A, in some embodiments, step 802 may be a step of selecting at least one self-propelled walking drill rig 18, with an operational and handling capacity to drill at least one vertical wellbore 17 and to then under-ream at least portion of that wellbore 17 for make at least one human-made cavern 15. In some embodiments, a selected walking drill rig 18 may also be used to drill connector wellbore(s) 17*a*. In some embodiments, more than one walking drill rig 18 may be selected (and used) to allow simultaneous drilling operations to be implemented at separate drill sites 9*a* over the grid pattern 51. In this simultaneous operation, purposely selected multiple drilling sites 9*a* may be drilled in a parallel time operations. In some embodiments, this parallel operation may be desired to meet operational deadlines, time requirements, or other demands on the waste disposal operation. In some embodiments, step 802 may progress to step 803.

Continuing discussing FIG. 8A, in some embodiments, step 803 may be a step of locating and moving a selected walking drill rig 18 to a selected drill site 9*a* on the grid pattern 51. In some embodiments, step 803 may be a step of placing a first walking drill rig 18 at one of the at least one drill sites 9*a*. This operation may typically referred to as "mobilization" in the oil-field industry may allow more than one walking drill rig 18 to be mobilized simultaneously or sequentially. In some embodiments, step 803 may progress to step 804.

Continuing discussing FIG. 8A, in some embodiments, step 804 may be a step of setting up (e.g., stabilizing and preparing to drill) the given walking drill rig 18 over the selected drill site 9*a* on the grid pattern 51. This operation may typically be referred to as "spudding" in the oil-field industry may allow more than one walking drill rig 18 to be "spudded" simultaneously or sequentially if the operation may utilize a plurality of walking drill rigs 18. In some embodiments, step 804 may progress to step 805.

Continuing discussing FIG. 8A, in some embodiments, in step 805, vertical wellbore 17 may be drilled by the walking drill rig 18 from surface 9 (and from that given drill site 9*a*) to a prescribed (predetermined) depth of 2,000 to 30,000 feet, plus or minus 100 feet and to (or into) a given disposal formation 63. In some embodiments, step 805 may be a step of drilling a substantially vertical wellbore 17 from the surface 9 directly down to the deep geological formation 63 using the first walking drill rig 18, wherein the substantially vertical wellbore 17 may at least physically touch the deep geological formation 63. In some embodiments, successful completion of step 805 may then progress into step 806.

Continuing discussing FIG. 8A, in some embodiments, in step 806, a section of the wellbore 17 may be drilled into host rock 63 to initiate the formation of a given human-made cavern 15. In some embodiments, in step 806 an under-reaming device may be run into a distal/terminal portion of vertical wellbore 17 where it may be desired to form the given human-made cavern 15 in host rock 63, by use of that under reaming device. In some embodiments, via such under-reaming operations of the terminal/distal portions of wellbore 17, within host rock 63, the given human-made cavern 15 may be formed into the host rock 63. Within a location in host rock 63 where it may be desired to form the given human-made cavern 15, the under-reaming device may be activated and used to form that given human-made cavern 15. For example and without limiting the scope of the present invention, this under-reaming operation may involve deploying, extending, and/or activating multiple reaming devices. One or more reaming devices (e.g., in tandem) may be utilized to form the given human-made cavern 15 in host rock 63 (from wellbore 17). In some embodiments, in step 806 the under-reaming process may continue either directly or sequentially in phases to ream out human-made caverns 15 in host rock 63 to a depth (length) from 500 feet to 10,000 feet (plus or minus 100 feet), of vertical extent downwards within host rock 63, and with diameters from about 24 inches up to 120 inches, plus or minus six (6) inches. In some embodiments, successful completion of step 806 may result in the making at least one human-made cavern 15 entirely located within the given host rock 63. In some embodiments, step 806 may be a step of under-reaming a terminal portion of the substantially vertical wellbore 17 into the deep geological formation 63 using the first walking drill rig 18 to form a human-made cavern 15 that is located within the deep geological formation 63, wherein the human-made cavern 15 formed in the step 806 is a member of the plurality of human-made caverns 15 of the array that are located below the given grid pattern 51. In some embodiments, successful completion of step 806 may then progress into step 807.

Continuing discussing FIG. 8A, in some embodiments, in step 807 a given human-made cavern 15 reamed out (made) in step 806 may be conditioned internally by treating the inside surface, walls, top and/or bottom of the given human-made cavern 15 with various predetermined materials (e.g., chemicals and/or coating/sealing products). In some embodiments, the conditioning step 807 may be done to seal the cavern interior surfaces of the human-made caverns 15 against radionuclide migration. In some embodiments, conditioning of the interior human-made cavern 15 surfaces may be done by operational means from surface systems with wireline or similar oilfield practices equipment. The types of coatings for the interiors of the human-made caverns 15 may be one or more of: cements, epoxies, nanoparticles, ceramics, clays, paints, sprays, portions thereof, combinations thereof, and/or the like. The conditioned human-made cavern 15 may be in a state ready to accept the radioactive nuclear waste 16 processed on the surface 9. In some embodiments, after the step 806, the method 800/850 may further comprise step 807 of conditioning the human-made-cavern(s) 15 formed in the step 806, by treating at least most of interior surfaces of the human-made-cavern 15 formed in the step 806 with at least one protective material configured to minimize radionuclide migration. In some embodiments, step 807 of conditioning human-made cavern 15 interior surfaces may not be necessary for some types of host rock 63 which may be crystalline and having very low porosity and permeability levels; and in such situations, step 806 may progress to step 808, i.e., step 807 may be omitted from method 800. In some embodiments, successful completion of step 807 may then progress into step 808.

Continuing discussing FIG. 8A, in some embodiments, step 808 may be a decision step. In some embodiments, step 808 may be a step of determining and/or deciding whether at least some of the remaining steps of method 800 may be occurring concurrently/simultaneously or whether at least some of the remaining steps of method 800 may occur in a sequential/serial fashion. In some embodiments, this step 808 may decide and/or determine whether making additional wellbores 17 and/or additional human-made caverns 15 via at least one walking drill rig 18 may occur concurrently, while loading of nuclear waste materials 16 may be done by another separate rig (e.g., another walking drill rig 18, or a smaller "workover" rig, or the like) in a different already completed wellbore 17 and human-made cavern 15. It may be necessary to implement simultaneous operations depending on the required and/or desired outcomes for the overall waste disposal process, such as, but not limited to, outcomes from step 801, and/or other operational goals/deadlines. In some applications of embodiments of the present invention, disposal operations times may be a critical factor and overall costs may be secondary. In some embodiments, step 808 may lead to step 809 or step 811.

In some embodiments, step 808 may be omitted and step 806 or step 807 may progress to step 809.

Continuing discussing FIG. 8A, in some embodiments, step 809 may be a step of moving ("walking") a given walking drill rig 18 to another drill site 9*a* within the grid pattern 51. In some embodiments, step 809 may involve the self-propelled movement of walking drill rig 18 from its current completed and drilled well drill site 9*a* to a new yet to-be-drilled (new/different) well drill site 9*a*. In some embodiments this walking motion of the given walking drill rig 18 may be accomplished initially by rig controller module(s) 18*a* activating/engaging the rig walking legs 18*b* via the hydraulic line(s) 18*e* and/or horizontal rig mover devices 18*c* and/or vertical rig mover device 18*d*, as needed depending upon the terrain of surface 9. In some embodiments, the rig walking legs 18*b* may raise the walking drill rig 18 a required distance vertically off the ground surface 9 by activating/engaging the vertical mover devices 18*d*. In some embodiments, while the walking drill rig 18 may be elevated off the ground surface 9, the controller modules 18*a* may via the hydraulic line(s) 18*e* initiate lateral (horizontal) movement, (e.g., "walking" and/or "skidding") of the walking drill rig 18 using the horizontal mover devices 18*c*. In some embodiments, this movement/translation action may move the walking drill rig 18 in any one of the many available directions as shown in FIG. 4B and to the new drill site 9*a* within the grid pattern 51. In some embodiments, the controller module(s) 18*a* by repeating the rig movement actions may move the walking drill rig 18 tens of feet in an hour to relocate walking drill rig 18 over a new drill site 9*a*. In some embodiments, step 809 may be a step of walking the first walking drill rig 18 to another of the least one drill sites 9*a* and repeating the steps 805 and 806 to form other of the human-made caverns 15 selected from the plurality of human-made caverns 15, wherein the step 809 executes if all of the at least one drill sites 9*a* do not have one of the human-made-caverns 15 located directly and vertically below. In some embodiments, successful completion of step 809 may then progress into step 810.

Continuing discussing FIG. 8A, in some embodiments, step 810 may be a decision step. In some embodiments, in step 810 a determination is made if all the required well sites 9*a* have been drilled and reamed out to form human-made caverns 15 over the total designated grid pattern 51. If not, then the human-made cavern 15 forming processes may return method 800 to step 804 to initiate the drilling and the formation of a new human-made cavern 15. In some embodiments, step 804, step 805, step 806, (and step 807 if desired or needed), and step 809 may be repeated until all human-made caverns 15 for that drill pattern 51 are completed. In some embodiments, if all human-made caverns 15 for that drill pattern 51 are completed, then step 810 may progress to step 811 and/or step 814. In some embodiments, if all well sites 9*a* in the grid pattern 51 have been drilled, then method 800 may continue to step 811 and/or to step 814. In some embodiments step 810 may lead to step 804. In some embodiments step 810 may lead to step 811 and/or to step 814.

Continuing discussing FIG. 8A, in some embodiments, step 811 may be a step of placing, locating, loading, pumping, injecting, inserting, landing, combinations thereof, and/or the like of predetermined amounts of nuclear waste materials 16 into a given human-made cavern 15, via the given wellbore 17 that is connected to that given human-made cavern 15 and from the surface 9. In some embodiments, step 811 may be a step of loading at least some of the radioactive waste 16 into at least one of the human-made caverns 15 selected from the plurality of human-made caverns 15 formed from the step 809. This placement process may continue until the given human-made cavern 15 is filled with a precalculated quantity of nuclear waste 16. In some embodiments, in step 811 the radioactive waste material 16 that may be placed into the given cavern 15 may be in a predetermined form. In some embodiments, before executing step 811, the nuclear waste materials 16 may be converted (processed) into the predetermined forms that may be more manageable, such as, but not limited to: substantially solidified, substantially liquified, substantially made into a gel, substantially made into pellets, substantially in a rock format, substantially in a brick format, substantially made into powder, substantially made into a slurry, substantially made into a foam, substantially treated with predetermined chemical mixtures, portions thereof, combinations thereof, and/or the like to enable easier transport and eventual sequestration into the human-made caverns 15. In some embodiments, walking drill rig 18 or the other types of rigs or other surface pumping/injecting equipment or the like, may be used to insert the nuclear waste materials 16 into the human-made caverns 15. In some embodiments, step 811 may progress into step 812.

In some embodiments, the step 811 may be executed by the first walking drill rig 18, after all the at least one drill sites 9*a* have one of the human-made caverns 15 selected from the plurality of human-made caverns 15, located directly vertically below; i.e., this may be an example of sequential operations for the method.

Continuing discussing FIG. 8A, in some embodiments, step 812 may be a step of injecting, pumping, inserting, filling, and/or landing protective materials, media, and/or additives (e.g., immersive protective medium 16*b*) into the given human-made cavern 15, with the nuclear waste materials 16, using the given wellbore 17 that connects to the given human-made cavern 15. This placement process may continue until human-made caverns 15 may be filled with a precalculated quantity of protective materials, media, and/or additives along with the already placed amount of nuclear waste 16. In some embodiments, the protective material inserted in step 812 into the given human-made cavern 15 may be protective blanket 16*a* (see e.g., FIG. 6) and/or immersive protective medium 16*b*. In some embodiments, protective blanket 16*a* may substantially cover over a top of the nuclear waste material 16 within the given human-made cavern 15. In some embodiments, protective blanket 16*a* may be some protective medium like a bentonite clay or a radionuclide absorber/inhibitor material that may be injected to remain above nuclear waste 16 within a given human-made cavern 15. In some embodiments, after the step 811, the method 800/850 may further comprise a step 812 of inserting (e.g., by injection and/or spray or the like) at least one protective material 16*a* over and on top of the at least some of the radioactive waste 16 that is located within the at least one of the human-made caverns 15. In some embodiments, the at least one protective material 16*a* may be selected from one or more of: bentonite, bentonite mud, bitumen, heavy oils, cement slurries, heavy oils, emulsions, nanotubes, portions thereof, combinations thereof, and/or the like. See e.g., FIG. 6 for protective blanket 16*a*. In some embodiments, this protective blanket 16*a* may behave as two-way barrier which may slow down physical migration of radioactive particles, fluid material, and other soluble compounds into or away from nuclear waste 16 mass that is stored in the given human-made caverns 15. In some embodiments, successful completion of step 812 may then progress into step 813. In some embodiments, step 813 may continue to step 817 which may be a terminal step.

Continuing discussing FIG. 8A, in some embodiments, step 814 may be a step of forming a connector wellbore 17*a* from a given drill site 9*a* using a walking drill rig 18 or the like. See e.g., FIG. 7B and its discussion of connector wellbores 17*a*. In some embodiments, a given connector wellbore 17*a* may connect at least one human-made cavern 15 with surface 9. In some embodiments, a given connector wellbore 17*a* may connect two human-made caverns 15 together, along with connecting to surface 9. In some embodiments, either before the step 811 or before the at least some of the radioactive waste 16 that is located within the at least one of the human-made caverns 15 reaches a predetermined level within the at least one of the human-made caverns 15, the method 800/850 may further comprise step 814 of drilling a connector wellbore 17*a* from the surface 9 to the at least one of the human-made caverns 15, such that the connector wellbore 17 intersects and pierces into the at least one of the human-made caverns 15. In some embodiments, the method 800/850 may further comprise step 814 of directing the connector wellbore 17*a* to intersect and pierce at least one other human-made cavern 15 selected from the plurality of human-made caverns 15. In some embodiments, the at least two human-made caverns 15 that may be intersected and pierced by the same connector wellbore 17*a*, may be adjacent to each other. See also, FIG. 7B. In some embodiments, the connector wellbore 17*a* may comprises at least one flow-control packer 17*d* configured to control flow of fluids through the connector wellbore 17*a*. In some embodiments, the at least one flow-control packer 17*d* may be located between two adjacent human-made caverns 15 selected from the plurality of human-caverns 15 that are both intersected and pierced by a same connector wellbore 17*a*. See also, FIG. 7B. In some embodiments, a given connector wellbore 17*a* may comprise: at least one perforation 17*b* in each intersected human-made cavern 15, at least one packer 17*d* between a pair of intersected human-made caverns 15, and at least one plug 17*c*. In some embodiments, a diameter of a given connector wellbore 17*a* may be between four (4) inches and twelve (12) inches, plus or minus one (1) inch. In some embodiments, a diameter of connector wellbore 17*a* may be smaller than a diameter of wellbore 17. In some embodiments, in step 814, the connector wellbore 17*a* may be cased with steel (or the like) casing all the way from the surface 9 and into the lateral section and finally across the human-made caverns 15. It should be pointed out that standard steel casing strings, casing sections or drill-pipe behind the drill bit, are usually about thirty (30) feet long and as such, traversing (extending) across a relatively small human-made cavern 15 of diameter less than six (6) feet is not an operational problem for the structurally rigid steel cylinder casing/piping.

Continuing discussing FIG. 8A and step 814, in some embodiments, the steel casing of the connector wellbore 17*a* may be perforated by perforating guns, (which are common tools in the oil drilling industry), at specific locations shown by perforations 17*b* in FIG. 7B. In some embodiments, the perforations 17*b* may be readily calculated accurately and reliability from drilling data and it is implemented at precise points along and in the connector wellbore 17*a* such that the perforations 17*b* in the casing pipe are made to be located within the human-made caverns 15 that are intersected by the given connector wellbore 17*a*. In some embodiments, these perforations 17*b* may allow injected fluids to enter or communicate from the connector wellbore 17*a* and into the human-made caverns 15 internal spaces. In some embodiments, in step 814 the connector wellbore 17*a* may be drilled and cased and perforated before the loading of waste 16 is initiated, or before the waste 16 is accumulated above a projected line of intersection of the given connector wellbore 17*a* within the given human-made cavern 15. In other words, it would not be beneficial to drill the connector wellbore 17*a* after the given human-made cavern 15 is full of waste 16 above where the connector wellbore 17*a* intersects that given human-made cavern 15. Drilling through nuclear waste 16 is not a good or recommended practice.

Continuing discussing FIG. 8A and step 814, in some embodiments, a (retrievable in some embodiments) flow-thru (flow-control) downhole packer 17*d* may be implemented from the surface 9 and inserted (landed) inside the bore of the given connector wellbore 17*a* to limit and/or control fluid movement selectively along and through the wellbore 17*a* during injection of protective materials and/or additives into the respective caverns 15 through the perforations 17*b*. By selectively operating these specialized packers 17*d*, it may be possible to selectively inject any sequence of human-made caverns 15 (that are intersected by connector wellbores 17*a*) by injection with protective materials and/or additives. In some embodiments, step 814 may progress to step 815.

Continuing discussing FIG. 8A, in some embodiments, step 815 may be a step of injecting protective materials and/or additives into a given human-made cavern 15, through perforations 17*b*, by use of the given connector wellbore 17*a* that intersects that given human-made cavern 15. In some embodiments, the method 800/850 may further comprise step 815 of injecting protective materials through perforations 17*b* in the connector wellbore 17*a*, wherein the perforations 17*b* may be located in at least a portion of the connector wellbore 17*a* that is positioned within a given human-made cavern 15 selected from the plurality of human-made caverns 15, such that protective materials that are injected through the perforations 17*b* are received into the given human-made cavern 15. See also, FIG. 7B. In some embodiments, use of the packers 17*d* may facilitate step 815. In some embodiments, these injected protective materials and/or additives, may be radionuclide absorbent/captor materials which may hold radioactive particles in place and slow down migration away from human-made caverns 15. In some embodiments, the protective materials and/or additives may provide protective measures to keep the waste material 16 from migrating away from the disposal human-made caverns 15 and polluting the environment. In some embodiments, for a given human-made cavern 15, step 815 may progress before or concurrently with step 811. In some embodiments, during step 811, pressure may be exerted at perforations 17*b* (e.g., via step 815) to minimize waste materials 16 from entering connector wellbore 17*a*. In some embodiments, use of packers 17*d* may also be used to minimize migration of waste materials 16 within connector wellbores 17*a*. In some embodiments, successful completion of step 815 may then progress into step 816.

Continuing discussing FIG. 8A, in some embodiments, step 816 may be a step of stopping the injection of protective materials and/or additives through connector wellbore 17*a* and perforations 17*b*. In some embodiments, in step 816 packers 17*d* may be left in closed configurations. In some embodiments, in step 816 connector wellbores 17*a* may be sealed, capped and/or otherwise closed (e.g., by use of predetermined plugs). In some embodiments, step 816 may lead to step 813.

In some embodiments, steps 814, 815, and 816 may be omitted from method 800 (see e.g., FIG. 7A).

Continuing discussing FIG. 8A, in some embodiments, method 800 may comprise a step (e.g., step 813) of shutting down the disposal process in a given deep human-made cavern 15. In some embodiments, method 800 may comprise a step (e.g., step 813) of sealing a given human-made cavern 15 and its wellbore(s) 17 (and 17*a* if any), by using one or more of: downhole plugs, packers, cement plugs; which may plug and seal off the applicable wellbore(s) 17 (and 17*a* if any). In some embodiments, a means (e.g., buildings, structures, fencing, flags, signage, transponder, etc.) to safely mark the location of the sealed/closed wellbores 17 (and 17*a* if any) on the Earth's surface 9 may be implemented. In some embodiments, after the step 811, the method 800/850 may further comprise a step 813 of sealing and/or closing off the substantially vertical wellbore 17 that leads to the at least one of the human-made caverns 15 with the at least some of the radioactive waste 16. In some embodiments, step 813 may progress to step 817, when all such wellbores 17 and 17*a* may be closed and/or sealed off.

Continuing discussing FIG. 8A, in some embodiments, step 817 may finally terminate and stop the operational disposal processes of method 800.

Figure 8B:
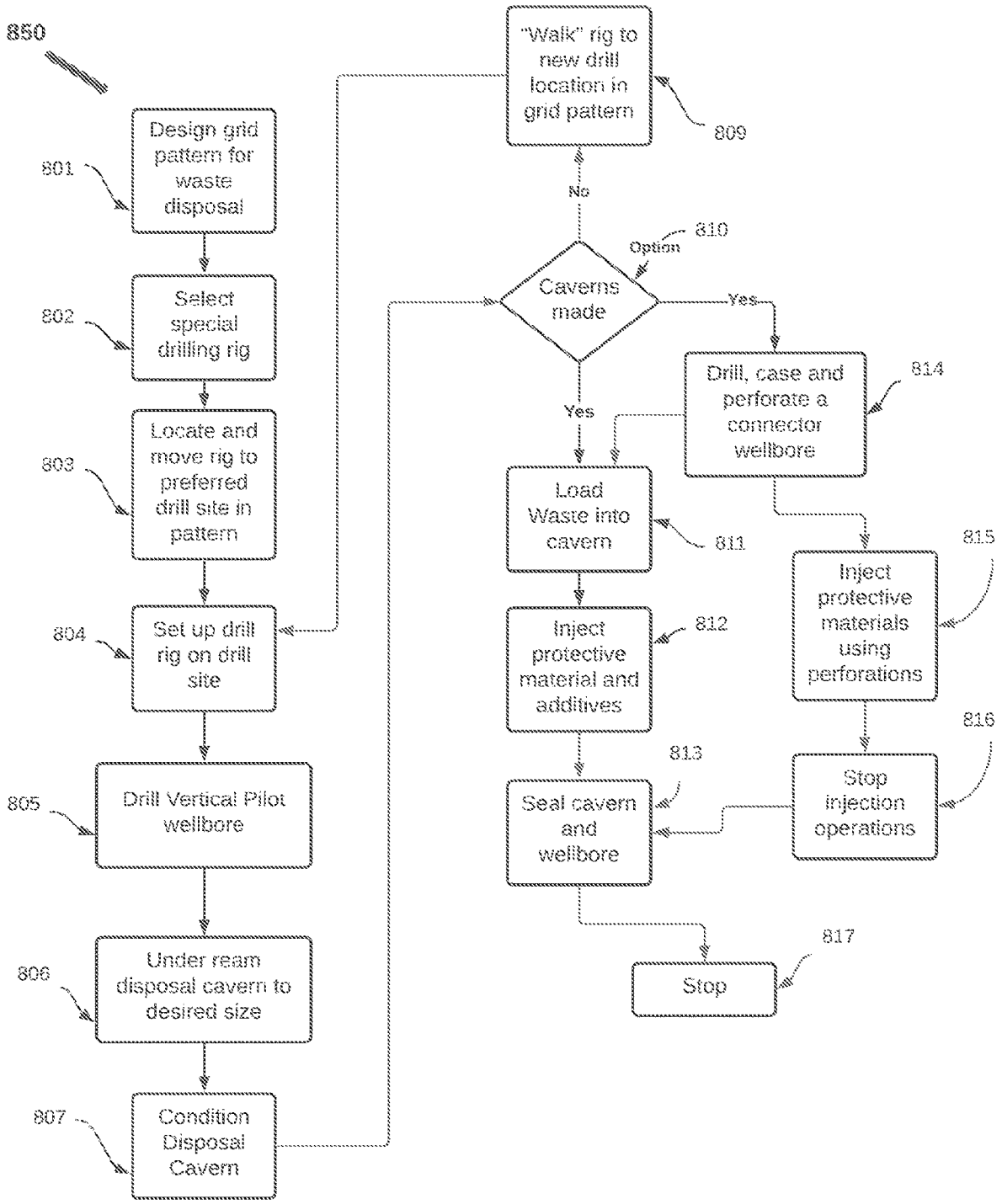
FIG. 8B may depict at least some steps in a method of disposing of nuclear waste materials using human-made caverns arranged in a gridded pattern.

FIG. 8B may depict at least of the steps for method 850. In some embodiments, method 850 may be similar to method 800, e.g., sharing the same goals and/or objectives, such as being a method of disposing of nuclear waste materials 16 within a plurality of human-made caverns 15 that are arranged in a gridded pattern beneath a grid pattern 51. In some embodiments, method 850 may also share many steps with method 800; however, at least some of the steps in method 850 may be executed in a different order. In some embodiments, method 850 may comprise the steps of: 801, 802, 803, 804, 805, 806, 807, 809, 810, 811, 812, 813, 814, 815, 816, 817, portions thereof, combinations thereof, and/or the like. In some embodiments, the steps of method 850 may occur as described above for method 800, except for the differences as noted below.

Continuing discussing FIG. 8B, in method 850, steps 801 to 807 may proceed as discussed above for method 800; except in method 850 step 806 or step 807 may proceed to step 810. In some embodiments, in method 850, the "yes" pathways from step 810 may proceed as was discussed above for method 800, i.e., the "yes" pathways from step 810 may proceed to step 811 and/or to step 814. However, the "no" pathway from step 810 in method 850 may proceed to step 809 and then step 809 may proceed to step 804.

Also note that while step 808 is not explicitly called out in method 850, note that "simultaneous operations" may occur in method 850 as well as in method 800. Note, in this context, "simultaneous operations" may refer to the making of new/additional human-made caverns 15 (e.g., per step 804 to step 807) within the given grid pattern 51 using at least one walking drill rig 18 (to build out the array of a plurality of human-made caverns 15); while nuclear waste 16 filling operations into already formed human-made caverns 15 (e.g., step 811 to step 816) is concurrently occurring by use of at least one other different rig (which may be another/different walking drill rig 18 or some other type of rig [e.g., a workover rig]). Note, in some embodiments, method 850 and/or method 800 may also execute without such simultaneous operations.

With respect to FIG. 8A and/or FIG. 8B, in some embodiments, a path which may comprise step 811, step 812, and step 813 may be a typical load (of nuclear waste 16) and seal path for a given human-made cavern 15 under the given grid pattern 51(and in the deep geological formation 63); whereas, a different path that may comprise step 814, step 815, step 816, step 811, step 812, and step 813 may be used if at least one lateral connector wellbore 17*a* may be implemented to connect at least some of the deep human-made caverns 15 under the given grid pattern 51 (and in the deep geological formation 63).

In some embodiments, method 800 and/or method 850 may be a method for disposing of radioactive waste 16 into a plurality of human-made caverns 15 that may be arranged in a predetermined array pattern within a deep geological formation 63, wherein the plurality of human-made caverns 15 may be located substantially vertically below grid pattern 51. In some embodiments, method 800 and/or method 850 may comprise steps 801, 803, 805, 806, 809, and 811.

In some embodiments, the step 811 and the step 809 may occur simultaneously by a different rig (e.g., a rig other than the first walking drill rig 18) performing the step 811 while the first walking drill rig 18 performs the step 809. In some embodiments, the different rig may be a second walking drill rig 18 or a workover rig or the like. Such operations may be examples of simultaneous operations.

In some embodiments, during the step 809 by the first walking drill rig, a second walking drill rig 18 may form others of the plurality of human-made caverns 15 by drilling other substantially vertical wellbores 17 into the deep geological formation 63 and under-reaming distal portions of those other substantially vertical wellbores 17. In some embodiments, the first and/or the second walking drill rigs 18 may be used in executing step 811 and/or other steps of method 800/850. That is, in some embodiments, method 800/850 may be carried out with two or more walking drill rigs and/or other types of drill rigs.

In some embodiments, the predetermined array pattern of a distribution of the plurality of human-made caverns 15 may located (substantially) vertically directly below the predetermined grid pattern 51, with each human-made cavern 15 selected from the plurality of human-made caverns 15 being linked to the surface 9 by one of the substantially vertical wellbores 17. See e.g., FIG. 7A, FIG. 7B, FIG. 6, and FIG. 5.

In some embodiments, prior to the step 811, the at least some of the radioactive waste 15, that is to be loaded within the at least one of the human-made caverns 15 in the step 811, may be formed into a "particular format" (preprocessed into a particular format). In some embodiments, this "particular format" is selected from one or more of: solid, liquid, liquified, slurry, pellet, powder, brick, spherical, ball, gel, rod, cylindrical, briquette, foam, portions thereof, combinations thereof, and/or the like. In some embodiments, each human-made cavern 15 selected from the plurality of human-made caverns 15 may be configured to receive the particular format by having a predetermined length, a predetermined diameter, and optionally by having a majority of interior surfaces treated with at least one predetermined material. See e.g., FIG. 7A and note the different texture/hash patterns of the nuclear waste material 16 within the human-made caverns 15 that denotes the nuclear waste material 16 of different particular formats. For example, and without limiting the scope of the present invention, the more flowable/liquified/slurry like particular formats of the nuclear waste material 16 may only need relatively smaller diameters of human-made cavern 15 as compared to particular formats with SNF subassemblies still at least partially intact.

Systems and methods for nuclear waste disposal in gridded array/pattern of geologically deep located human-made caverns has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for disposing of radioactive waste into a plurality of human-made caverns that are arranged in a predetermined array pattern within a deep geological formation, wherein the method comprises steps of:

(a) forming a predetermined grid pattern on a surface of the Earth that is vertically directly above the deep geological formation, wherein the predetermined grid pattern comprises a plurality of grids, wherein a sub-set of the plurality of grids comprises at least one drill site per grid selected from the sub-set;

(b) placing a first walking drill rig at one of the at least one drill sites;

(c) drilling a substantially vertical wellbore from the surface directly down to the deep geological formation using the first walking drill rig, wherein the substantially vertical wellbore at least touches the deep geological formation;

(d) under-reaming a terminal portion of the substantially vertical wellbore into the deep geological formation using the first walking drill rig to form a human-made cavern that is located within the deep geological formation, wherein the human-made cavern formed in the step (d) is a member of the plurality of human-made caverns;

(e) walking the first walking drill rig to another of the least one drill sites and repeating the steps (c) and (d) to form other of the human-made caverns selected from the plurality of human-made caverns, wherein the step (e) executes if all of the at least one drill sites do not have one of the human-made-caverns located directly and vertically below; and (f) loading at least some of the radioactive waste into at least one of the human-made caverns selected from the plurality of human-made caverns.

2. The method according to claim 1, wherein the deep geological formation is located from 2,000 feet to 30,000 feet directly below the surface, plus or minus 1,000 feet.

3. The method according to claim 1, wherein the deep geological formation is selected from one or more of: impermeable sedimentary rock, very low permeability sedimentary rock, impermeable metamorphic rock, very low permeability metamorphic rock, impermeable igneous rock, very low permeability ingenious rock, portions thereof, or combinations thereof.

4. The method according to claim 1, wherein the step (f) is executed by the first walking drill rig after all the at least one drill sites have one of the human-made caverns selected from the plurality of human-made caverns, located directly vertically below.

5. The method according to claim 1, wherein the step (f) and the step (e) occur simultaneously by a different rig performing the step (f) while the first walking drill rig performs the step (e).

6. The method according to claim 5, wherein the different rig is a second walking drill rig or is a workover rig.

7. The method according to claim 1, wherein during the step (e), a second walking drill rig forms others of the plurality of human-made caverns by drilling other substantially vertical wellbores into the deep geological formation and under-reaming distal portions of those other substantially vertical wellbores.

8. The method according to claim 1, wherein the predetermined array pattern of a distribution of the plurality of human-made caverns is located vertically directly below the predetermined grid pattern, with each human-made cavern selected from the plurality of human-made caverns being linked to the surface by one of the substantially vertical wellbores.

9. The method according to claim 1, wherein after the step (d), the method further comprises a step of conditioning the human-made-cavern formed in the step (d), by treating at least most of interior surfaces of the human-made-cavern formed in the step (d) with at least one material configured to minimize radionuclide migration.

10. The method according to claim 1, wherein prior to the step (f) the at least some of the radioactive waste, that is to be loaded within the at least one of the human-made caverns in the step (f), is formed into a particular format.

11. The method according to claim 10, wherein the particular format is selected from one or more of: solid, liquid, liquified, slurry, pellet, powder, brick, spherical, ball, gel, rod, cylindrical, briquette, foam, portions thereof, or combinations thereof.

12. The method according to claim 10, wherein each human-made cavern selected from the plurality of human-made caverns is configured to receive the particular format by having a predetermined length, a predetermined diameter, and optionally by having a majority of interior surfaces treated with at least one predetermined material.

13. The method according to claim 1, wherein after the step (f), the method further comprises a step of inserting at least one protective material over and on top of the at least some of the radioactive waste that is located within the at least one of the human-made caverns.

14. The method according to claim 13, wherein the at least one protective material is selected from one or more of: bentonite, bentonite mud, bitumen, heavy oils, cement slurries, heavy oils, emulsions, nanotubes, portions thereof, or combinations thereof.

15. The method according to claim 1, wherein after the step (f), the method further comprises a step of sealing and closing the substantially vertical wellbore that leads to the at least one of the human-made caverns with the at least some of the radioactive waste.

16. The method according to claim 1, wherein either before the step (f) or before the at least some of the radioactive waste that is located within the at least one of the human-made caverns reaches a predetermined level within the at least one of the human-made caverns, the method further comprises a step of drilling a connector wellbore from the surface to the at least one of the human-made caverns, such that the connector wellbore intersects and pierces into the at least one of the human-made caverns.

17. The method according to claim 16, wherein the method further comprises a step of injecting protective materials through perforations in the connector wellbore, wherein the perforations are located in at least a portion of the connector wellbore that is positioned within a given human-made cavern selected from the plurality of human-made caverns, such that protective materials that are injected through the perforations are received into the given human-made cavern.

18. The method according to claim 16, wherein method further comprises a step of directing the connector wellbore to intersect and pierce at least one other human-made cavern selected from the plurality of human-made caverns.

19. The method according to claim 16, wherein the connector wellbore comprises at least one flow-control packer configured to control flow of fluids through the connector wellbore.

20. The method according to claim 19, wherein the at least one flow-control packer is located between two adjacent human-made caverns selected from the plurality of human-caverns that are both pierced by the connector wellbore.

21. The method according to claim 1, wherein each human-made cavern selected from the plurality of human-made caverns has a predetermined diameter and a predetermined length.

22. The method according to claim 21, wherein the predetermined diameter is selected from a range of twenty-four (24) inches to 120 inches; wherein the predetermined length is selected from a range of 500 feet to 10,000 feet.

23. The method according to claim 21, wherein the predetermined diameter or the predetermined length of one human-made cavern selected from the plurality of human-made caverns is different from the predetermined diameter or the predetermined length of another human-made cavern selected from the plurality of human-made caverns.

24. The method according to claim 1, wherein the radioactive waste is selected from one or more of: nuclear waste, high-level nuclear waste (HLW), spent nuclear fuel (SNF), weapons grade plutonium (WGP), uranium-based waste products, depleted uranium products, depleted uranium penetrators (DUP), uranium hexafluoride (UF6), portions thereof, or combinations thereof.

* * * * *